US007995012B2

(12) United States Patent
Yanai et al.

(10) Patent No.: US 7,995,012 B2
(45) Date of Patent: Aug. 9, 2011

(54) LIGHT EMITTING DEVICE

(75) Inventors: Hiromi Yanai, Kanagawa (JP); Shuhei Nagatsuka, Kanagawa (JP); Akihiro Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 985 days.

(21) Appl. No.: 11/612,226

(22) Filed: Dec. 18, 2006

(65) Prior Publication Data

US 2007/0146254 A1 Jun. 28, 2007

(30) Foreign Application Priority Data

Dec. 27, 2005 (JP) ..... 2005-375405

(51) Int. Cl.
*G09G 3/32* (2006.01)

(52) U.S. Cl. ..... 345/82

(58) Field of Classification Search ..... 345/76–83; 315/169.3; 372/38.01–38.09, 38.1
See application file for complete search history.

(56) References Cited

U.S. PATENT DOCUMENTS 3,967,257 A * 6/1976 Hager ..... 340/664
6,528,951 B2 3/2003 Yamazaki et al.
6,710,548 B2 3/2004 Kimura
6,788,003 B2 9/2004 Inukai et al.
2001/0030511 A1 10/2001 Yamazaki et al.
2001/0033252 A1* 10/2001 Yamazaki et al. ..... 345/7
2004/0263444 A1 12/2004 Kimura
2005/0012731 A1 1/2005 Yamazaki et al.
2005/0017963 A1 1/2005 Yamazaki et al.
2005/0017964 A1 1/2005 Yamazaki et al.
2005/0285823 A1 12/2005 Kimura et al.
2006/0033452 A1 2/2006 Yamazaki et al.
2006/0038501 A1 2/2006 Koyama et al.

FOREIGN PATENT DOCUMENTS

JP 2002-333861 11/2002
WO WO 2006/011666 A1 2/2006

* cited by examiner

*Primary Examiner* — Alexander Eisen
*Assistant Examiner* — Robin Mishler
(74) *Attorney, Agent, or Firm* — Fish & Richardson P.C.

(57) ABSTRACT

A display device in which characteristic change of an organic light emitting layer due to deterioration or temperature change can be detected to keep the constant luminance of a light emitting element is provided. A monitor region is provided in addition to a pixel portion for display. A plurality of monitor elements is arranged in the monitor region. A switching circuit is provided so as to prevent a large amount of current from flowing in a shorted monitor element among the plurality of monitor elements. As a result, by monitoring potential change between electrodes of the monitor element, the voltage or the current that is supplied to a light emitting element in the pixel portion for display can be corrected in accordance with time degradation or temperature change.

8 Claims, 15 Drawing Sheets

LIGHT EMITTING DEVICE

BACKGROUND OF THE INVENTION

1. Field of the Invention

The present invention relates to a light emitting device that has a light emitting element.

2. Description of the Related Art

Since a light emitting element has a self-light emitting property, it is superior in visibility and a viewing angle. Accordingly, a light emitting device that has a light emitting element has been attracted as well as a liquid crystal display device (LCD).

As a light emitting element, an organic EL element in which several organic layers are interposed between an anode and a cathode is given. The organic layer specifically includes a light emitting layer, a hole injecting layer, an electron injecting layer, a hole transporting layer, and an electron transporting layer. In such an organic EL element, light can be extracted by applying a potential difference between a pair of electrodes.

When a light emitting device is put into practical use, it is considered that life extension of the organic EL element is an important topic. Time degradation of the organic layer causes luminance reduction of the organic EL element. The rate of time degradation depends on material characteristics, a sealing method, a driving method of the light emitting device, or the like. In addition, since the organic layer is particularly weak in moisture, oxygen, light, and heat, the time degradation is also promoted by factors thereof.

In addition, when the light emitting device is put into practice use, the amount of current flowing in the organic EL element is desired to be constant without depending on the temperature. Even if the voltage applied between electrodes of the organic EL element is the same, the current flowing in the light emitting element becomes increase as the temperature of the organic layer becomes higher. In other words, when constant voltage driving is performed to the light emitting device, luminance change and chromaticity discrepancy occur in accordance with the temperature change. In the light emitting device having such an organic EL element, a technique in which the luminance of the light emitting element is to be constant independently from the environmental temperature is proposed (Patent Document 1: Japanese Published Patent Application No. 2002-333861).

SUMMARY OF THE INVENTION

However, in a case of using the technique of Patent Document 1, reduction of the yield due to a monitor element is concerned. For example, productivity is decreased due to short of the monitor element that does not relate to display. In addition, by causing a defect in the monitor element, accurate monitoring can not be performed.

Therefore, it is an object of the present invention to provide a light emitting device having a monitor element, in which reduction of the yield due to the monitor element is not caused.

In the present invention, potential change with time degradation, temperature change, or the like, which is applied between electrodes of a monitor element, can be monitored by the monitor element. In addition, the voltage or the current that is supplied to a light emitting element of a pixel portion for display is corrected by the monitor element.

Further, in the present invention, a control transistor that is connected to the monitor element is included. Furthermore, a control unit is also included, which turns off the control transistor in a case where short occurs between the electrodes of the monitor element. As the control unit for turning off the control transistor, a switching circuit is included.

The monitor element is a light emitting element that is manufactured in a monitor region by the same manufacturing condition and the same process as a light emitting element of a pixel portion. Therefore, electric characteristics of the monitor element are equivalent to those of the light emitting element of the pixel portion. In other words, the light emitting element of the pixel portion and the monitor element have the same or approximately the same characteristics with respect to the temperature change and the time degradation.

Thus, one mode of the present invention is a light emitting device including a monitor element, a monitor line connected to the monitor element, and a means for electrically interrupting a current supplied to the monitor element in a case where anode potential of the monitor element is lowered.

Another mode of the present invention is a light emitting device including a monitor element, a monitor line connected to the monitor element, a means for supplying a constant current to the monitor line, a control transistor for controlling supply of the current from the monitor line to the monitor element, and a switching circuit to which potential of one of electrodes of the monitor element and one of electrodes of the control transistor is inputted for outputting the potential to a gate electrode of the control transistor.

An input terminal of the switching circuit is connected to a second electrode of the control transistor, and an output terminal thereof is connected to a gate of the control transistor. For example, the control transistor can be turned off in a case where the control transistor is a p-type, potential at a Low (L) level is inputted to the switching circuit by the short between electrodes of the monitor element, and potential at a High (H) level is outputted from the switching circuit.

In the present invention, the monitor element may be paired. One of monitor elements that are paired is referred to as a main monitor element (a first monitor element), and the other is referred to as a sub-monitor element (a second monitor element). A light emitting device of the present invention includes a monitor line that monitors potential change between electrodes of monitor elements that are paired. It is to be noted that the monitor elements that are paired can be electrically connected to a common monitor line.

In a case of including monitor elements that are paired, a first control transistor in which a first electrode is connected to a monitor line and a second electrode is connected to a first monitor element, and a main switching circuit (also refereed to as a first switching circuit) that gives input to a gate of the first control transistor are included. In addition, a second control transistor in which a first electrode is connected to the monitor line and a second electrode is connected to a second monitor element, and a sub-switching circuit (also referred to as a second switching circuit) that gives input to a gate of the second control transistor.

That is, another mode of the present invention is a light emitting device including a first monitor element, a second monitor element that is paired with the first monitor element, a monitor line connected to the first monitor element and the second monitor element, and a means for electrically interrupting a current supplied to the first monitor element and turning on the second monitor element that is paired with the first monitor element in a case where anode potential of the first monitor element is lowered.

In accordance with such a mode of the present invention, for example, the first control transistor can be turned off in a case where the first control transistor is a p-type, potential at a Low (L) level is inputted to the first switching circuit by the short between the electrodes of the first monitor element, and potential at a High (H) level is outputted from the first switching circuit. Further, for example, the second control transistor can be turned off in a case where the second control transistor is a p-type, potential at a Low (L) level is inputted to the second switching circuit by the short between the electrodes of the second monitor element, and potential at a High (H) level is outputted from the second switching circuit. At this time, a negative power supply of the second switching circuit is connected to an input terminal of the first switching circuit.

In accordance with such a configuration of the present invention, even if the first monitor element causes short between the electrodes, the second monitor element can be turned on, and the number of effective monitor elements is not changed.

As the switching circuit that has a function for turning off the control transistor as the above, an inverter can be used. However, the switching circuit is not limited to the inverter as long as it can output potential at an H level and an L level in accordance with input.

In the present invention, it is a feature that a plurality of monitor elements is provided. In addition, it is also a feature that a plurality of pairs of the first monitor elements and the second monitor element is provided Further, another mode of the present invention is a driving method for turning off a first monitor element and turning on a second monitor element in a case where the first monitor element is shorted in the first and second monitor elements that are paired with each other.

According to the present invention, a light emitting device can be provided, in which vivid color display that has no luminance discrepancy for each color of R (red), G (green), and B (blue) can be performed by suppressing luminance change of a light emitting element due to time degradation and temperature change.

DETAILED DESCRIPTION OF THE INVENTION

Figure 1:
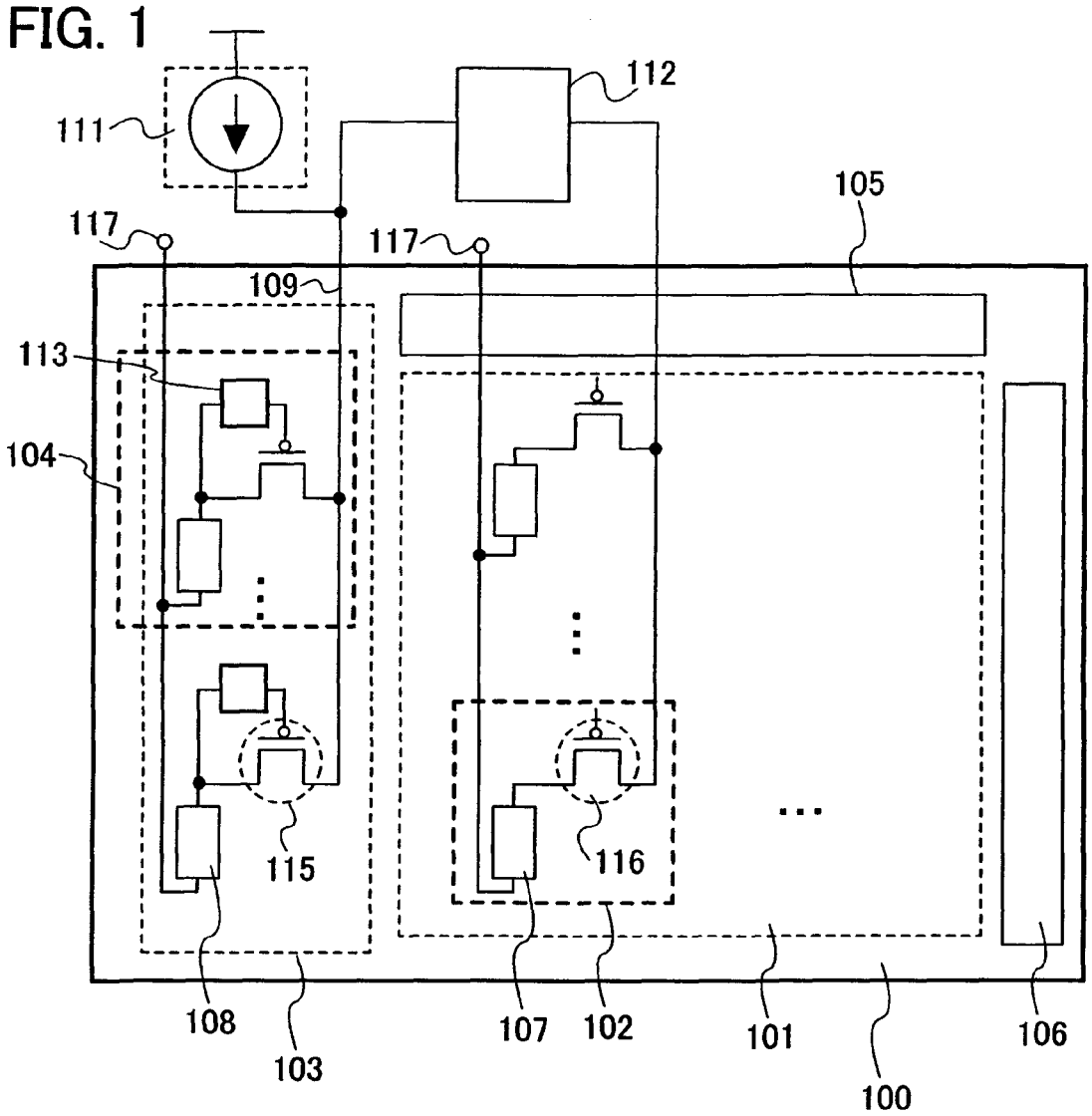
FIG. 1 is a diagram for showing a light emitting device of the present invention.

Embodiment Modes of the present invention will be described below based on drawings. However, the present invention can be implemented in various modes, and it is to be easily understood that various changes and modifications will be apparent to those skilled in the art, unless such changes and modifications depart from the content and the scope of the invention. Therefore, the present invention is not construed as being limited to the description of this embodiment mode. It is to be noted that the same portion or a portion having the same function is denoted by the same reference numeral in all the drawings for describing Embodiment Modes, and the description thereof is omitted.

In the present specification, a source electrode and a drain electrode of a transistor are names that are adopted to distinguish between electrodes other than a gate electrode for convenience in a structure of the transistor. Therefore, when polarity of the transistor is not limited in the present invention, the source electrode or the drain electrode is referred to as either a first electrode or a second electrode.

In the present specification, a connection of each element means an electric connection. Accordingly, another element (such a resistor, a condenser, a semiconductor element, or a switching element) may be interposed between elements that are connected to each other.

Embodiment Mode 1

In this embodiment mode, a configuration of a light emitting device that has a monitor element will be explained.

FIG. 1 shows a light emitting device provided with a pixel portion 101, a monitor region 103, a signal line driver circuit 105, and a scanning line driver circuit 106 over an insulating substrate 100.

In the pixel portion 101, a plurality of pixels 102 is provided. In each pixel, a light emitting element 107 and a transistor (hereinafter, referred to as a driving transistor) 116 that has a function for controlling supply of the current, which is connected to the light emitting element 107, are provided. The light emitting element 107 is connected to a power supply 117.

In such a light emitting element, positive and negative charges are injected from an electrode into a light emitting layer, and the charges are recombined to make an excited state. Excitons change energy to light and return to a ground state. This light emission is called fluorescence or phosphorescence. The fluorescence is light emission in a case of returning from a singlet excited state to the ground state. The phosphorescence is light emission in a case of returning from a triplet excited state to the ground state.

Light emission from the light emitting element can be extracted from a light transmitting substrate side, and a light emitting device that emits light from one side or both sides can be provided.

In a monitor circuit 104, a monitor element 108, a monitor element control transistor (also referred to as a control transistor) 115 that is connected to the monitor element 108, and a switching circuit 113 of which an output terminal is connected to a gate electrode of the control transistor and an input terminal is connected to a second electrode of the control transistor 115 and the monitor element are included.

A constant current source 111 is connected to the control transistor 115 through a monitor line 109. The control transistor 115 has a function for controlling supply of the current from the monitor line to each of a plurality of monitor elements. The monitor line can have a function for monitoring change of electrode potential of the monitor element. Further, the constant current source may have a function for supplying the constant current to the monitor line.

Then, the present invention includes the control transistor 115 and the switching circuit 113, which are connected to the monitor element 108. Accordingly, an operation defect of the monitor circuit 104 that is caused by a defect (including an initial defect and a defect with time) of the monitor element 108 can be prevented. For example, when the control transistor 115 is not connected to the switching circuit 113, an anode and a cathode included in one monitor element 108 among a plurality of monitor elements may be shorted (short-circuited) due to a defect in a manufacturing process, or the like. Accordingly, the large amount of current from the constant current source 111 is supplied to the monitor element 108 that is shorted through the monitor line 109. An organic layer of a light emitting element is generally a substance close to an insulator, even if it has low or high molecular weight. Therefore, the light emitting element has high resistance. However, a resistance value of the light emitting element becomes close to "0" in a case where the short occurs between electrodes of the light emitting element, and the large amount of the current is supplied to the shorted monitor element. Further, even in a case of incompletely short, when resistance is lowered to some content, the excessive current begins to flow in the monitor element.

The plurality of monitor elements is connected in parallel. Therefore, when the large amount of the current is supplied to the shorted monitor element 108, the predetermined constant current is not supplied to the other monitor elements. As a result, appropriate potential of the monitor element 108 can not be supplied to the light emitting element 107. However, in the present invention, the above problem is prevented by providing the switching circuit 113 between the constant current source 111 and the control transistor 115.

Therefore, the present invention includes the control transistor 115 and the switching circuit 113. The control transistor 115 has a function for stopping the supply of the current to the monitor element 108 that is shorted in order to prevent supply of the excessive current due to short of the monitor element 108, or the like. Thus, in the present invention, a transistor that has a function for electrically interrupting the shorted monitor element and the monitor line from each other is provided.

The switching circuit 113 has a function for turning off the control transistor 115 in a case where any of the plurality of the monitor elements 108 is shorted. Specifically, the switching circuit 113 has a function for outputting potential that turns off the control transistor 115. In addition, the switching transistor 113 has a function for turning on the control transistor 115 in a case where the monitor element 108 is not shorted. Specifically, the switching circuit 113 has a function for outputting potential that turns on the control transistor 115.

Figure 2A:
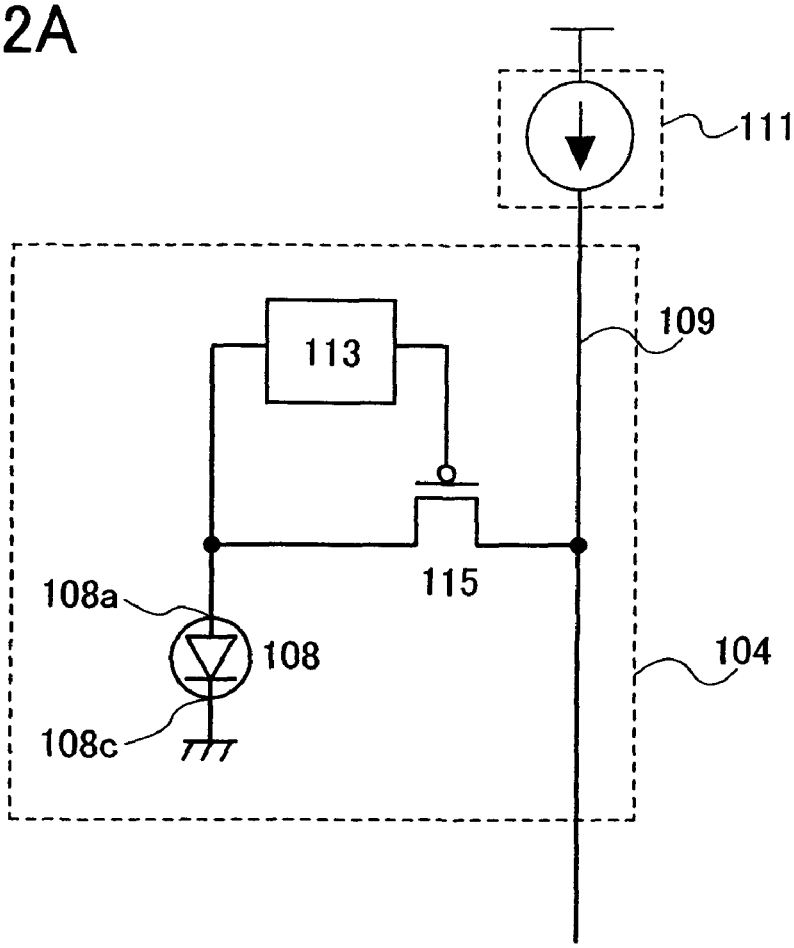
FIGS. 2A and 2B are a diagram for showing a monitor pixel circuit of the present invention and a view for showing a timing chart thereof.
Figure 2B:
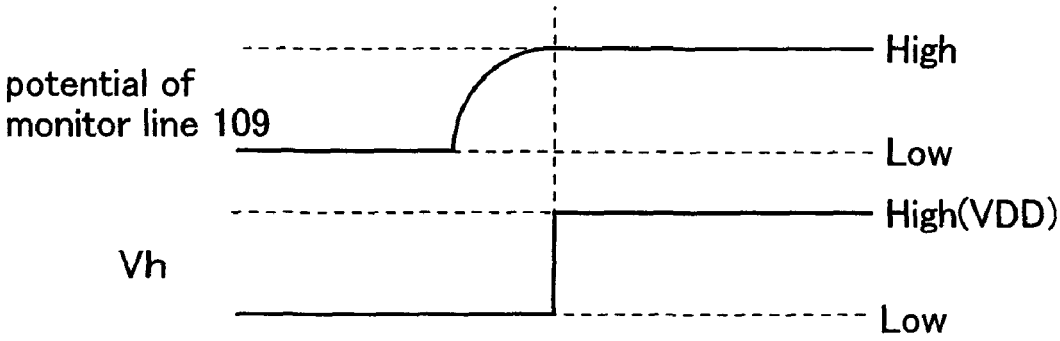

A detailed operation of the monitor circuit 104 is explained with the use of FIGS. 2A and 2B. As shown in FIG. 2A, when an anode is an anode electrode 108*a* and a cathode is a cathode electrode 108*c* in an electrode included in the monitor element 108, the anode electrode 108*a* is connected to an input terminal of the switching circuit 113, and the cathode electrode 108*c* is connected to the power supply 117. The cathode electrode 108*c* connected to the power supply 117 is set to be at constant potential. Therefore, when the anode and the cathode included in the monitor element 108 are shorted with each other, potential of the anode electrode 108*a* is close to potential of the cathode electrode 108*c*. As a result, low potential that is close to the potential of the cathode electrode 108*c* is supplied to the switching circuit 113, and the switching circuit 113 outputs potential VDD on a high potential side of potential Vh. Accordingly, the potential VDD is to be gate potential of the control transistor 115. In other words, potential inputted to a gate of the control transistor 115 is to be VDD, and the control transistor 115 is turned off. Here, the potential VDD is a potential by which the control transistor 115 can be turned off enough.

It is to be noted that the potential VDD that is to be the high potential side Vh is set to be the same as or higher than the anode potential. Further, a low potential side outputted from the switching circuit 113, potential of the power supply 117, and a low potential side of the monitor line 109 can be all equivalent. The low potential side can be generally ground potential. However, the low potential side is not limited thereto, and the low potential side may be determined so as to have a predetermined potential difference with the high potential side. The predetermined potential difference can be determined by the current, the voltage, and the luminance characteristics of an organic layer that is to be a light emitting material, or specification of a device.

Here, order in which the constant current flows in the monitor element 108 is to be noted. The constant current is needed to flow in the monitor line 109 in a state where the control transistor 115 is turned on. In this embodiment mode, the current begins to flow in the monitor line 109 with keeping Vh at an L level as shown in FIG. 2B. After the potential of the monitor line 109 becomes a saturated state, Vh is set to be the potential VDD. As a result, the monitor line 109 can be charged even if the control transistor 115 is in an on-state.

On the other hand, in a case where the monitor element 108 is not shorted, the potential of the anode electrode 108*a* is supplied to the switching circuit 113; therefore, potential on the low potential side is outputted from the switching circuit 113, and the control transistor 115 is turned on.

In such a manner, the current from the constant current source 111 can be set not to be supplied to the monitor element 108 that is shorted. Accordingly, when a monitor element is shorted in a case where a plurality of monitor elements exists, potential change of the monitor line 109 can be suppressed at the minimum by interrupting supply of the current to the shorted monitor element. As a result, appropriate potential of the monitor element 108 can be supplied to the light emitting element 107.

It is to be noted that a light emitting element in a pixel portion for display is simply referred to as a light emitting element, and a light emitting element in a monitor region is referred to as a monitor element in order to distinguish the light emitting elements from each other in the present specification. However, the monitor element 108 is manufactured by the same process based on the same manufacturing condition as the light emitting element 107 and has the same structure as that of the light emitting element 107. Therefore, the monitor element 108 has the same electric characteristics as those of the light emitting element in the pixel portion. In other words, the light emitting element and the monitor element has the same or appropriately the same characteristics with each other with respect to temperature change and time degradation.

Such a monitor element 108 is connected to the power supply 117. Here, a power supply connected to the light emitting element 107 and the power supply connected to the monitor element 108 have the same potential with each other; therefore, they are described as "power supply 117" by using the same reference numeral.

It is to be noted that polarity of the control transistor 115 is a p-channel type in this embodiment mode; however, the present invention is not limited to this, and an n-channel type may be used. In this case, a surrounding circuit configuration may be appropriately changed.

A position where such a monitor circuit 104 is provided is not limited. The monitor circuit 104 may be provided in the pixel portion 101 and between the signal line driver circuit 105 or the scanning line driver circuit 106 and the pixel portion 101.

A buffer amplifier circuit 112 is provided between the monitor circuit 104 and the pixel portion 101. The buffer amplifier circuit indicates a circuit having characteristics such that input and output are at the same potential, input impedance is high, and output current capacitance is high. When a circuit has such characteristics, a circuit configuration can be appropriately determined.

In such a configuration, the buffer amplifier circuit has a function for changing the voltage applied to the light emitting element 107 included in the pixel portion 101 in accordance with potential change of one of the electrodes of the monitor element 108.

In such a configuration, the constant current source 111 and the buffer amplifier circuit 112 may be provided over the same insulating substrate 100 or separate substrate.

In the above configuration, the constant current is supplied from the constant current source 111 to the monitor element 108. When the temperature change and the time degradation are caused in this state, a resistance value of the monitor element 108 is changed. For example, the time degradation is caused, the resistance value of the monitor element 108 is increased. Since the current value supplied to the monitor element 108 is constant, the potential difference at both ends of the monitor element 108 is changed. Specifically, the potential difference between the electrodes included in the monitor element 108 is changed. At this time, potential of the electrode connected to the power supply 117 is constant; therefore, the potential of the electrode connected to the constant current source 111 is changed. The potential change of the electrode is supplied to the buffer amplifier circuit 112 through the monitor line 109.

That is, the potential change of the above electrode is inputted to an input terminal of the buffer amplifier circuit 112. Further, the potential outputted from an output terminal of the buffer amplifier 112 is supplied to the light emitting element 107 through the driving transistor 116. Specifically, the outputted potential is given as the potential of one of the electrodes included in the light emitting element 107.

In such a manner, the potential change of the electrode of the monitor element 108 in accordance with the temperature change or the time degradation change is fed back to the light emitting element 107. As a result, the luminance change of the light emitting element due to the temperature change and the time degradation change is suppressed, and a light emitting device in which vivid color display can be performed without luminance discrepancy for each color of R (red), G (green), and B (blue) can be provided.

Furthermore, since a plurality of the monitor elements 108 is provided, the potential change of these monitor elements can be averaged to be supplied to the light emitting element 107. In other words, the potential change can be averaged by providing a plurality of the monitor elements 108 in the present invention.

It is to be noted that the constant current source 111 may be a circuit that can supply the constant current in this embodiment mode, and for example, the constant current source 111 can be manufactured using a transistor over the substrate 100.

This embodiment mode is explained so that the monitor circuit 104 includes a plurality of the monitor elements 108, the control transistor 115, and the switching circuit 113; however, the present invention is not limited to this. For example, any circuit may be used as long as the switching circuit 113 has a function for detecting short of the monitor element and interrupting the current that is supplied to the shorted monitor element through the monitor line 109. Specifically, the switching circuit 113 may have a function for turning off the control transistor 115 in order to interrupt the current supplied to the shorted monitor element.

Further, in this embodiment mode, a monitor operation can be performed by using a plurality of the monitor elements 108, even if any of the monitor elements 108 becomes defective.

In this embodiment mode, the buffer amplifier circuit 112 is provided to prevent variations in the potential. Therefore, a circuit other than the buffer amplifier circuit 112 may be used as long as it is a circuit that can prevent variations in the potential, like the buffer amplifier circuit 112. In other words, when a circuit for preventing variations in the potential is provided between the monitor element 108 and the light emitting element 107 in a case of transmitting the potential of one of the electrodes of the monitor element 108 to the light emitting element 107, a circuit having any configuration may be used for such a circuit without being limited to the buffer amplifier circuit 112 as the above.

Embodiment Mode 2

In this embodiment mode, an inverter will be explained as a specific example of a switching circuit in the above monitor circuit configuration.

Figure 3:
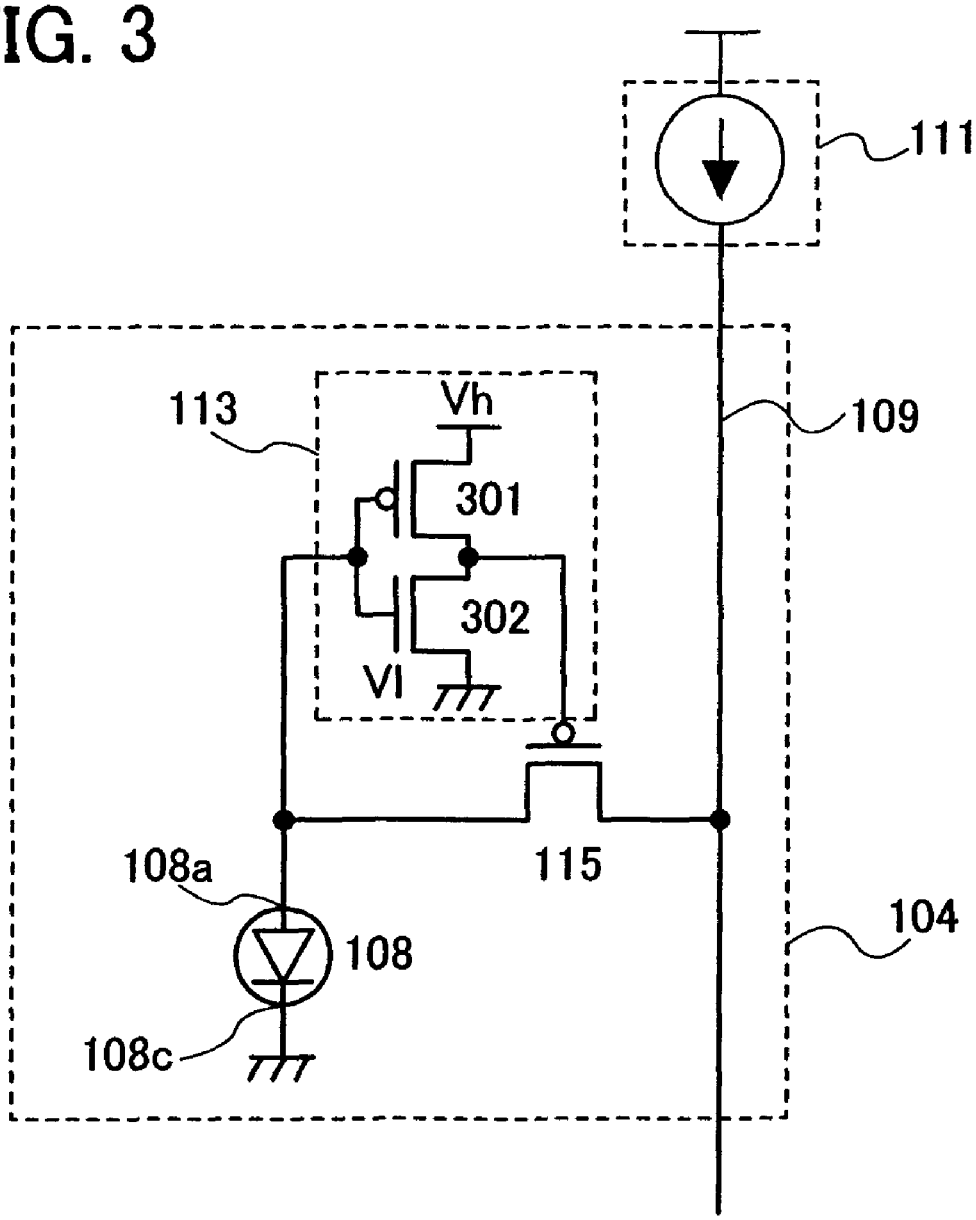
FIG. 3 is a diagram for showing a monitor pixel circuit of the present invention.

FIG. 3 shows a monitor circuit configuration using an inverter as a switching circuit 113. In a monitor circuit 104, a monitor element 108, a control transistor 115 that is connected to the monitor element 108, and a switching circuit 113 of which an output terminal is connected to a gate electrode of the control transistor 115 and an input terminal is connected to a second electrode of the control transistor 115 and the monitor element 108 are included. A constant current source 111 is connected to the control transistor 115 through a monitor line 109.

The switching circuit 113 has a function for outputting potential that turns off the control transistor 115 in a case where any of a plurality of the monitor elements 108 is shorted. In addition, the switching circuit 113 has a function for outputting potential that turns on the control transistor 115 in a case where none of the plurality of the monitor elements is shorted.

When any of the plurality of the monitor elements is shorted, low potential close to potential of a cathode electrode 108*c* is inputted to the switching circuit 113; therefore, a p-channel transistor 301 included in the switching circuit 113 is turned on. Accordingly, potential VDD on a high potential side of potential Vh is outputted from the switching circuit 113, and the potential VDD is inputted to a gate of the control transistor 115. In other words, the control transistor 115 is turned off. Timing is the same as explained in Embodiment Mode 1 with the use of FIG. 2B.

In order to prevent supply of a large amount of current due to short of the monitor element 108, or the like, the control transistor 115 is turned off, and the supply of current to the monitor element 108 that is shorted is stopped. That is, the shorted monitor element and the monitor line can be electrically interrupted.

On the other hand, in a case where the monitor element 108 is not shorted, potential of an anode electrode 108*a* is supplied to the switching circuit 113; therefore, an n-channel transistor 302 is turned on. Accordingly, potential on a low potential side is outputted from the switching circuit 113, and the control transistor 115 is turned on.

Embodiment Mode 3

Figure 4:
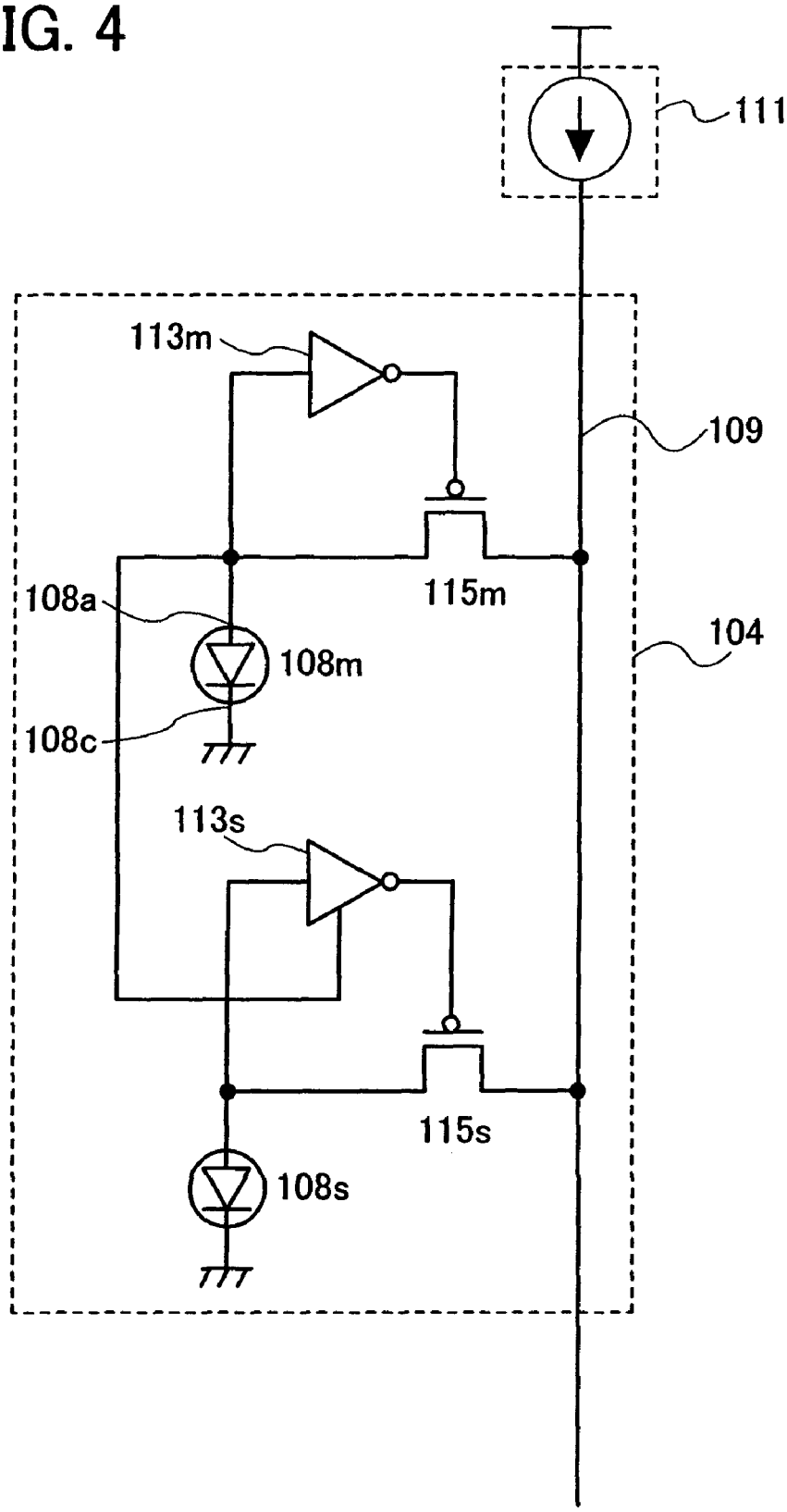
FIG. 4 is a diagram for showing a monitor pixel circuit of the present invention.

In this embodiment mode, a circuit configuration in which each monitor element is paired, which is different from the above monitor circuit, will be explained with the use of FIG. 4. One of the pair of the monitor elements is referred to as a main monitor element (also referred to as a first monitor element) 108*m*, and the other is refereed to as a sub-monitor element (also referred to as a second monitor element) 108*s*.

A monitor line 109 is connected to the first monitor element 108*m* and the second monitor element 108*s*, which are paired with each other, in common. The monitor line 109 can monitor each potential change between electrodes of the first monitor element 108*m* and the second monitor element 108*s*.

Further, a main monitor element control transistor (also referred to as a first control transistor) 115*m* is included. A first electrode of the transistor is connected to the monitor line 109, and a second electrode of the transistor is connected to the first monitor element 108*m*. A first switching circuit 113*m* that gives input to a gate of the first control transistor 115*m* is included. Since an inverter is used as the switching circuit in this embodiment mode, the first switching circuit is also referred to as a main inverter or a first inverter.

Furthermore, a sub-monitor element control transistor (also referred to as a second control transistor) 115*s* is included. A first electrode of the transistor is connected to the monitor line 109, and a second electrode of the transistor is connected to the second monitor element 108*s*. A second switching circuit 113*s* that gives input to a gate of the second control transistor 115*s* is included. Since an inverter is used as the switching circuit in this embodiment mode, the second switching circuit is also referred to as a sub-inverter or a second inverter.

A constant current source 111 is connected to the first control transistor 115*m* and the second control transistor 115*s* through the monitor line 109. The constant current source 111 may have a function for supplying the constant current to the monitor line 109. The first control transistor 115*m* has a function for controlling supply of the current from the monitor line 109 to the monitor element 108*m* that is paired. The second control transistor 115*s* has a function for controlling supply of the current from the monitor line 109 to the second monitor element 108*s* that is paired. Such a monitor line 109 has a function for monitoring the potential change of the electrode of the monitor element.

A connection of an inverter is explained. An input terminal of the first inverter 113*m* is connected to the second electrode of the first control transistor 115*m*, and an output terminal thereof is connected to the gate of the first control transistor 115*m*. When the electrodes of the first monitor element 108*m* are shorted, by such a connection, potential at an L level is inputted to the first inverter 113*m*, and output of the first inverter 113*m* is to be at an H level. Therefore, the first control transistor 115*m* can be turned off.

An input terminal of the second inverter 113*s* is connected to the second electrode of the second control transistor 115*s*, and an output terminal thereof is connected to the gate of the second control transistor 115*s*. When the electrode of the first monitor element 108*m* is shorted, by such a connection, potential of an anode electrode 108*a* of the first monitor element is lowered at an L level. A negative power supply of the second inverter 113*s* is connected to the input terminal of the first inverter, and the second inverter 113*s* outputs potential at an L level. Therefore, the second control transistor 115*s* can be turned on.

It is to be noted that polarity of the control transistors 115*m* and 115*s* are explained as a p-channel type in this embodiment mode; however, the present invention is not limited to this, and an n-channel type may be used. In this case, a surrounding circuit configuration may be appropriately changed.

Further, in the present invention, the negative power supply of the second inverter 113*s* may be connected to the input terminal of the first inverter 113*m*. By employing this configuration, even if the electrode of the first monitor element 108*m* is shorted, the second monitor element 108*s* is turned on, and the desired number of monitor elements that are actually turned on is not reduced. It is to be noted that the number of the monitor elements that are actually turned on is also referred to as the number of effective monitor elements.

The number of the monitor elements can be appropriately determined by a designer in accordance with the current, the voltage, and the luminance characteristics of a light emitting element. For example, in a full color display device, the same number of the monitor elements may be set for each light emitting element exhibiting colors of R (red), G (green), and B (blue). Alternatively, the different number of the monitor elements may be set for each light emitting element exhibiting colors of R (red), G (green), and B (blue). In the monitor circuit configurations explained in Embodiment Mode 1 and Embodiment Mode 2, in a case where there is a defective monitor element, the number of the effective monitor elements becomes smaller than the desired number of the monitor elements. In addition, a plurality of the monitor elements is each connected to the monitor line in parallel; therefore, the amount of current flowing in each monitor element becomes large when the number of the effective monitor element is changed. As a result, when the potential change of the monitor element is fed back to the light emitting element, the luminance becomes higher than the desired luminance.

Consequently, by providing the monitor element that is paired as shown in this embodiment mode, the number of effective monitor elements is not changed as long as one of the monitor elements is not shorted. Therefore, the amount of current flowing in each monitor element is not changed. As a result, when the potential change of the monitor element is fed back to the light emitting element, the desired luminance of the light emitting element can be constantly kept.

Embodiment Mode 4

In this embodiment mode, a circuit configuration and operation thereof will be explained, in which a control transistor is turned off in a case where a monitor element is shorted.

Figure 6A:
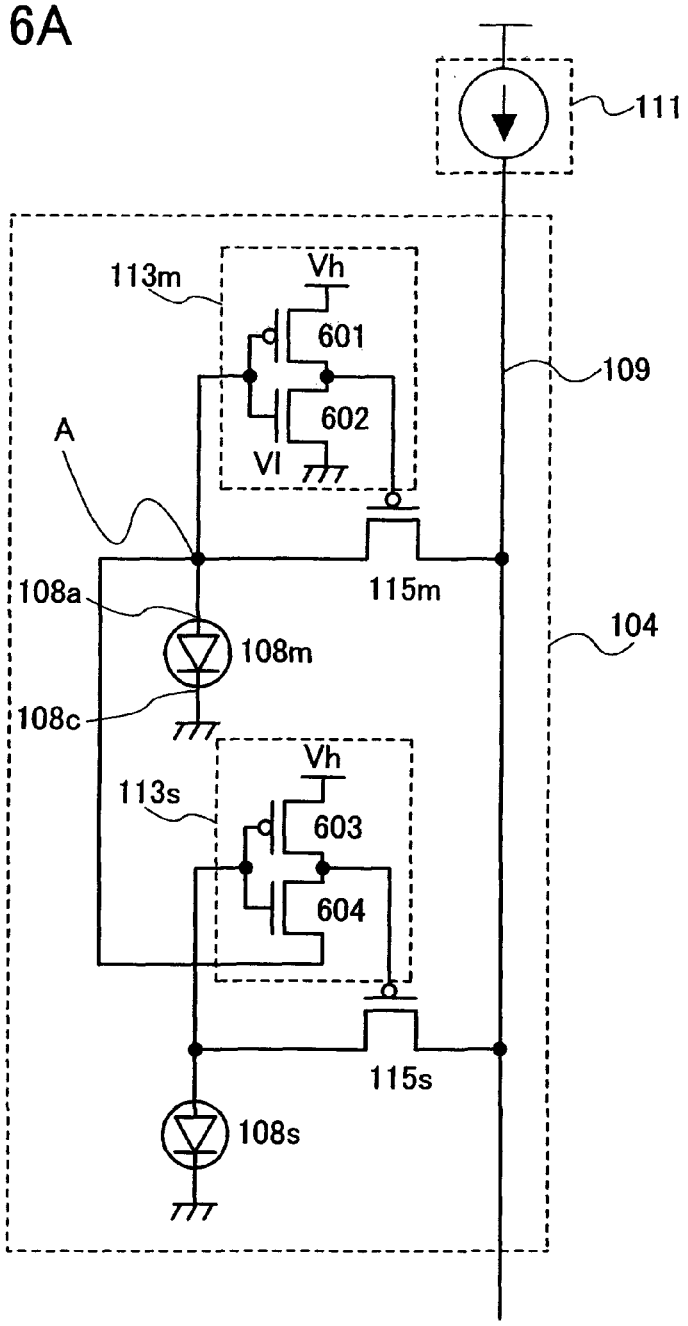
FIGS. 6A and 6B are a diagram for showing a monitor pixel circuit of the present invention and a view for showing a timing chart thereof.

A switching circuit 113*m* shown in FIG. 6A includes a first p-channel transistor 601, and a second n-channel transistor 602 that has a gate electrode in common with the first transistor 601 and is connected to the first transistor 601 in series. A monitor element 108*m* is connected to the gate electrode of the first and second transistors 601 and 602. A gate electrode of a control transistor 115*m* is connected to a drain electrode of the first transistor 601 and a drain electrode of the second transistor 602. Further, a switching circuit 113*s* includes a first p-channel transistor 603 and a second n-channel transistor 604 that has a gate electrode in common with the first transistor 603 and is connected to the first transistor 603 in series. A monitor element 108*s* is connected to the gate electrode of the first and second transistors 603 and 604. A gate electrode of a control transistor 115*s* is connected to a drain electrode of the first transistor 603 and a drain electrode of the second transistor 604.

Figure 6B:
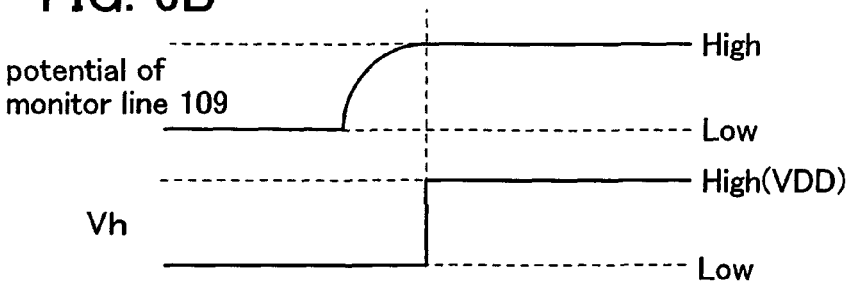

Potential of each source electrode of the first p-channel transistor 601 and 603 is set to be Vh, and potential of a source electrode of the second n-channel transistor 602 is set to be Vl. A source electrode of the second transistor 604 is connected to an anode electrode 108*a* of the monitor element 108*m*. Potential of a monitor line 109 and the potential Vh are driven as shown in FIG. 6B.

First, the potential of the monitor line 109 is made in a saturated state, and Vh is set to be at an H level (VDD). When the monitor element 108 is shorted, the potential of the anode electrode 108*a* of the monitor element 108*m*, that is, potential of a point A, is lowered to approximately the same level as that of a cathode electrode 108*c* of the monitor element 108*m*. Accordingly, low potential, that is, the potential at an L level, is inputted to the gate electrode of the first and second transistors 601 and 602, and then, the second transistor 602 that is the n-channel type is turned off, and the first transistor 601 that is the p-channel type is turned on. Thereafter, the potential VDD on a high potential side of the potential Vh is inputted to the gate electrode of the control transistor 115*m* by the first transistor 601, and the control transistor 115*m* is turned off. As a result, the current from the monitor line 109 is not supplied to the shorted monitor element 108*m*.

Since the potential of the point A is lowered to approximately the same level as that of the cathode electrode 108*c* of the monitor element 108*m*, the potential at an L level is inputted to the source electrode of the second transistor 604. The source potential (approximately the same level as that of the point A) of the first transistor 604 is inputted to the gate electrode of the control transistor 115*s*, and the control transistor 115*s* is turned on. As a result, even if the first monitor element 108*m* is shorted, the second monitor element 108*s* is turned on; therefore, the number of effective monitor elements is not changed, and normal correction of a light emitting element can be performed.

When the first monitor element 108*m* is normal, the control transistor 115*m* is controlled to be turned on. In other words, the potential of the anode electrode 108*a* becomes approximately the same level as the potential VDD on the high potential side of the potential Vh of the monitor line 109; therefore, the second transistor 602 is turned on. As a result, the low potential Vl is applied to the gate electrode of the control transistor 115*m* to be turned on. Further, since the potential of the source electrode of the second transistor 602 is the potential VDD on the high potential side of the potential Vh, the potential at an H level (VDD) is inputted to the gate electrode of the control transistor 115*s*. Therefore, the second monitor element 108*s* is turned off.

Figure 5:
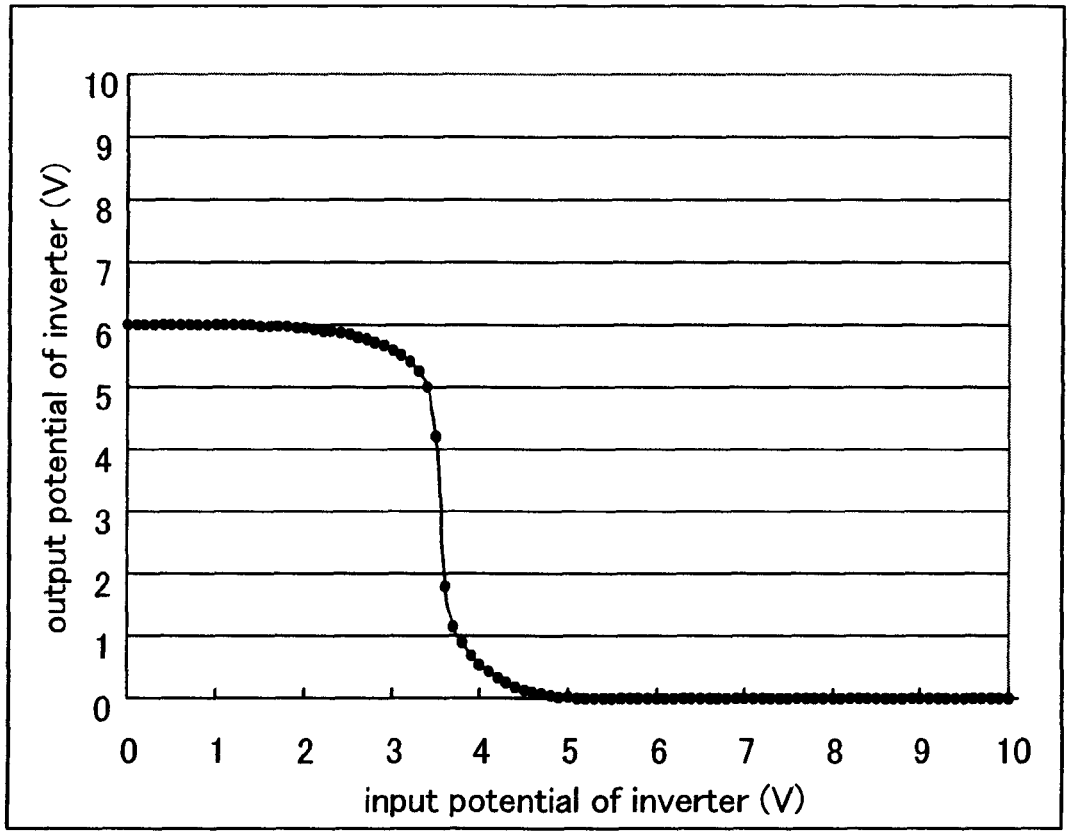
FIG. 5 is a graph for showing an inverter characteristic.

FIG. 5 shows a relation of input potential and output potential of one inverter. From this, the input potential can be found in a case of turning off the n-channel transistor and in a case of turning off the p-channel transistor. In this embodiment mode, in a case where anode potential in shorting a monitor element is to be input potential (V) to the inverter, it is determined that potential at an H level (VDD) from Vh is outputted to the output potential (V). As a result, a control transistor can be turned off. The relation of the input and output potential of the inverter is determined depending on a W/L ratio (hereinafter, refereed to as a pn ratio) that is a size of a p-channel transistor and an n-channel transistor. Accordingly, by designing a transistor size or a pn ratio by a designer in accordance with a purpose, a p-channel transistor and an n-channel transistor included in an inverter can be easily turned on or off.

That is, in order not to turn on the first monitor element and the second monitor element at the same time, a size of the p-channel transistors 601 and 603 and a size of the n-channel transistors 602 and 604 can be changed. For example, a size of the transistor may be designed so that the p-channel transistor 601 is turned on in advance at a time when the potential of the point A drops at an L level.

Embodiment Mode 5

In this embodiment mode, a circuit configuration different from the above circuit and operation thereof will be explained, in which a control transistor is turned off in a case where a monitor element is shorted. The portion that has the same operation explained in Embodiment Mode 4 is denoted by the same reference numeral as that in Embodiment Mode 4, and explanation thereof is omitted.

Figure 7:
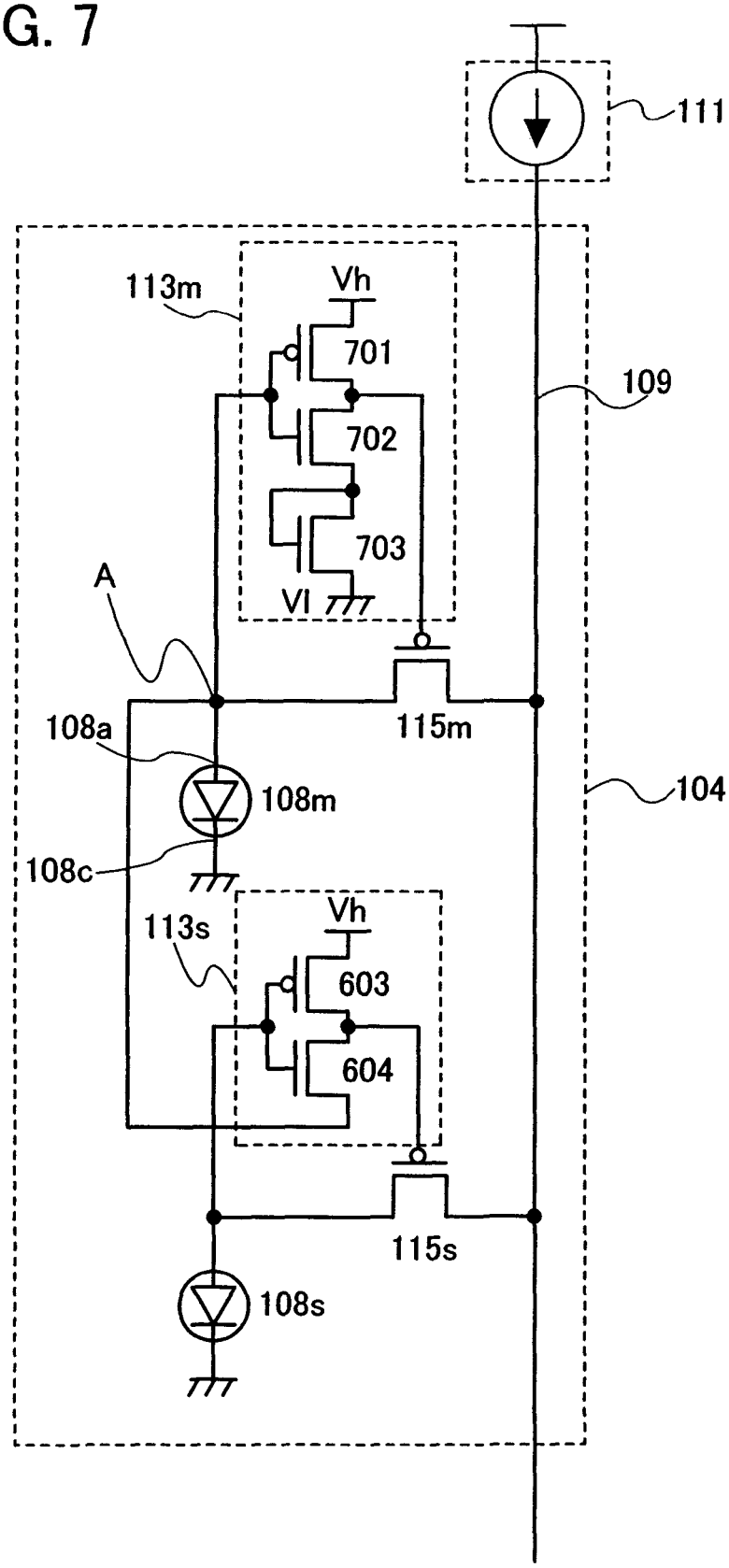
FIG. 7 is a diagram for showing a monitor pixel circuit of the present invention.

FIG. 7 shows a configuration of a first switching circuit 113*m*. The first switching circuit 113*m* includes a first p-channel transistor 701, a second n-channel transistor 702 that has a gate electrode in common with the first transistor and is connected to the first transistor in series, and a third n-channel transistor 703 that is connected to the second transistor in series. A gate and a drain of the third transistor 703 have the same potential with each other. A gate electrode of a first control transistor 115*m* is connected to a drain electrode of the first transistor 701 and a drain electrode of the second transistor 702.

When a monitor element 108*m* is shorted, potential of an anode electrode 108*a* of the monitor element 108*m*, that is, potential of a point A, is lowered to approximately the same level as that of a cathode electrode 108*c* of the monitor element 108*m*. Accordingly, low potential, that is, the potential at an L level, is inputted to the gate electrode of the first transistor 701 and the second transistor 702. Then, the second transistor 702 that is the n-channel type is turned off, and the first transistor 701 that is the p-channel type is turned on. Thereafter, potential VDD on a high potential side of potential Vh of the first transistor 701 is inputted to the gate electrode of the control transistor 115*m*, and the control transistor 115*m* is turned off. As a result, the current from the monitor line 109 is not supplied to the monitor element 108*m* that is shorted.

Since the potential of the point A is lowered to approximately the same level as that of the cathode electrode 108*c* of the monitor element 108*m*, the potential at an L level is inputted to a source electrode of a second transistor 604. The source potential (approximately the same level as that of the point A) of the second transistor 604 is inputted to a gate electrode of a second control transistor 115*s*, and the second control transistor 115*s* is turned on. As a result, even if the first monitor element 108*m* is shorted, the number of effective monitor elements is not changed by a second monitor element 108*s*, and normal correction of a light emitting element can be performed.

In the first switching circuit 113*m*, output of the first switching circuit 113*m* is increased from an L level by the threshold value ($V_{th}$) of the third transistor 703 due to the third n-channel transistor 703, and the value of $Vl+V_{th}$ is inputted to a gate of the first control transistor 115*m*. At this time, the transistor in the first switching circuit is needed to be designed so that the first control transistor 115*m* can be turned on.

The first switching circuit 113*m* and the second switching circuit 113*s* may have different circuit configurations. In this case, a configuration is made so that the first switching circuit 113*m* can be turned off in advance at the time when the voltage of the point A drops.

In a case where both of the first monitor element and the second monitor element are normal without being shorted, the first control transistor 115*m* is controlled to be turned on by the first switching circuit. Further, the second control circuit is controlled to be turned off by the second switching circuit. At this time, since anode potential of the first monitor element 108*m* becomes approximately the same level of the high potential of the monitor line 109, the second transistor 702 is turned on. As a result, the potential at an L level is applied to the gate electrode of the first control transistor 115*m*, and then, the first control transistor 115*m* is turned on. On the other hand, the potential at an H level is inputted to the gate electrode of the second control transistor 115*m*, and then, the second control transistor 115*m* is turned off.

Embodiment Mode 6

In this embodiment mode, one example of a pixel circuit and a configuration thereof will be explained.

Figure 8A:
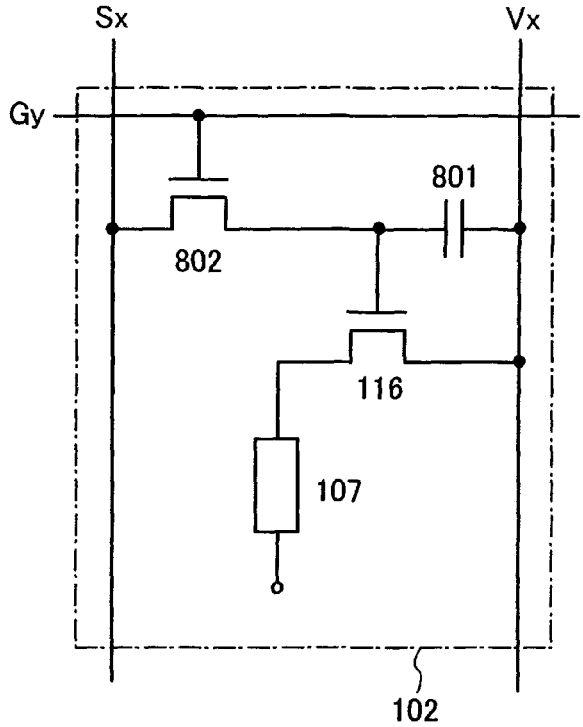
FIGS. 8A to 8C are a diagram for showing a pixel circuit of the present invention and views for each showing a timing chart thereof.

FIG. 8A shows a pixel circuit that can be used for a pixel portion of the present invention. In a pixel portion, a signal line Sx, a scanning line Gy, and a power supply line Vx are provided in a matrix, and a pixel 102 is provided at an intersection point thereof. The pixel 102 includes a switching transistor 802, a driving transistor 116, a capacitor element 801, and a light emitting element 107.

A connection relation in the pixel is explained. The switching transistor 802 is provided at an intersection point of the signal line Sx and the scanning line Gy. One of electrodes of the switching transistor 802 is connected to the signal line Sx, and a gate electrode of the switching transistor 802 is connected to the scanning line Gy. One of electrodes of the driving transistor 116 is connected to the power supply line Vx, and the gate electrode of the driver transistor 116 is connected to the other electrode of the switching transistor 802. The capacitor element 801 is provided so as to hold the voltage between gate-source electrodes of the driving transistor 116. In this embodiment mode, one of electrodes of the capacitor element 801 is connected to Vx, and the other electrode is connected to the gate electrode of the driving transistor 116. It is to be noted that the capacitor element 801 is not needed to be provided in a case where gate capacitance of the driving transistor 116 is large, the leak current is small, or the like. The light emitting element 107 is connected to the other electrode of the driving transistor 116.

A driving method of such a pixel is explained.

First, when the switching transistor 802 is turned on, a video signal is inputted from the signal line Sx. A charge is accumulated in the capacitor element 801 based on the video signal. When the accumulated charge in the capacitor element 801 becomes higher than the gate-source electrode voltage (Vgs) of the driving transistor 116, the driving transistor 116 is turned on. Then, the current is applied to the light emitting element 107, and it is lighted. At this time, the driving transistor 116 can be operated in a line region or a saturated region. When the driving transistor operates in the saturated region, the constant current can be supplied. Alternatively, when the driving transistor operates in the liner region, it can operate at lower voltage, whereby low power consumption can be achieved.

Hereinafter, a driving method of the pixel is explained with the use of a timing chart.

Figure 8B:
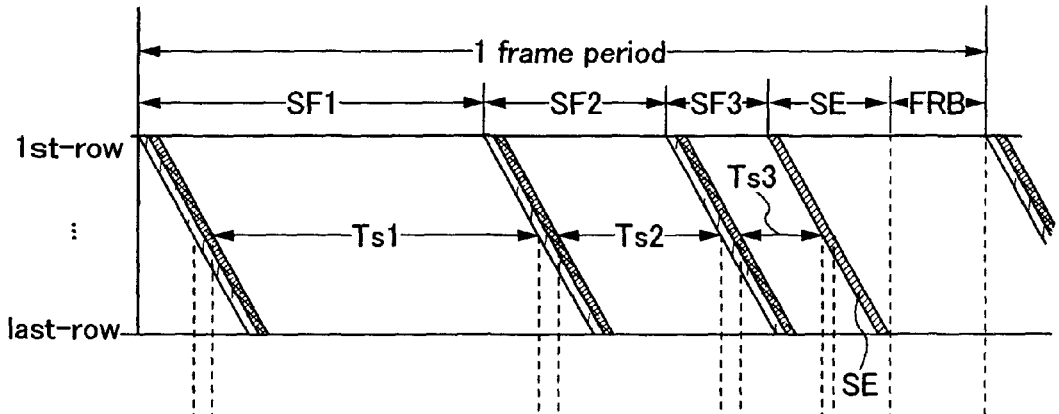

FIG. 8B shows a timing chart of one frame period in a case where an image of 60 frames is rewritten in one second. In the timing chart, a vertical axis indicates a scanning line G (first to last rows) and a horizontal axis indicates time.

One frame period includes m (m is a natural number of 2 or more) subframe periods SF1, SF2, . . . , and SFm. The m subframe periods SF1, SF2, . . . , and SFm each has writing operation periods Ta1, Ta2, . . . , and Tam, display periods (lighting periods) Ts1, Ts2, . . . , and Tsm, and a reverse bias voltage applying period. In this embodiment mode, as shown in FIG. 8B, one frame period includes subframe periods SF1, SF2, and SF3 and the reverse bias voltage applying period (FRB). In each subframe period, the writing operation periods Ta1 to Ta3 are sequentially performed, which are followed by the display periods Ts1 to Ts3, respectively.

Figure 8C:
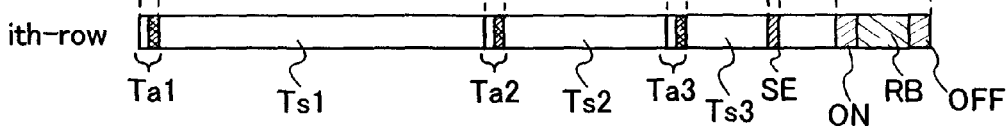

A timing chart shown in FIG. 8C shows a writing operation period, a display period, and the reverse bias voltage applying period of a certain row (i-th row). After the writing operation period and the display period are alternately performed, the reverse bias voltage applying period starts. The period including the writing operation period and the display period becomes a forward bias voltage applying period.

The writing operation period Ta can be divided into a plurality of operation periods. In this embodiment mode, the writing operation period Ta is divided into two operation periods, in which an erasing operation is performed in one period and a writing operation is performed in the other period. In this manner, a WE (Write Erase) signal is inputted in order to provide the erasing operation and the writing operation. Other erasing operation and writing operation and signals are explained in detail in the following embodiment mode.

In such a manner, control for providing an on-period, an off-period, and an erasing period is performed by driver circuits such as a scanning line driver circuit, a signal line driver circuit, and the like.

Figure 9:
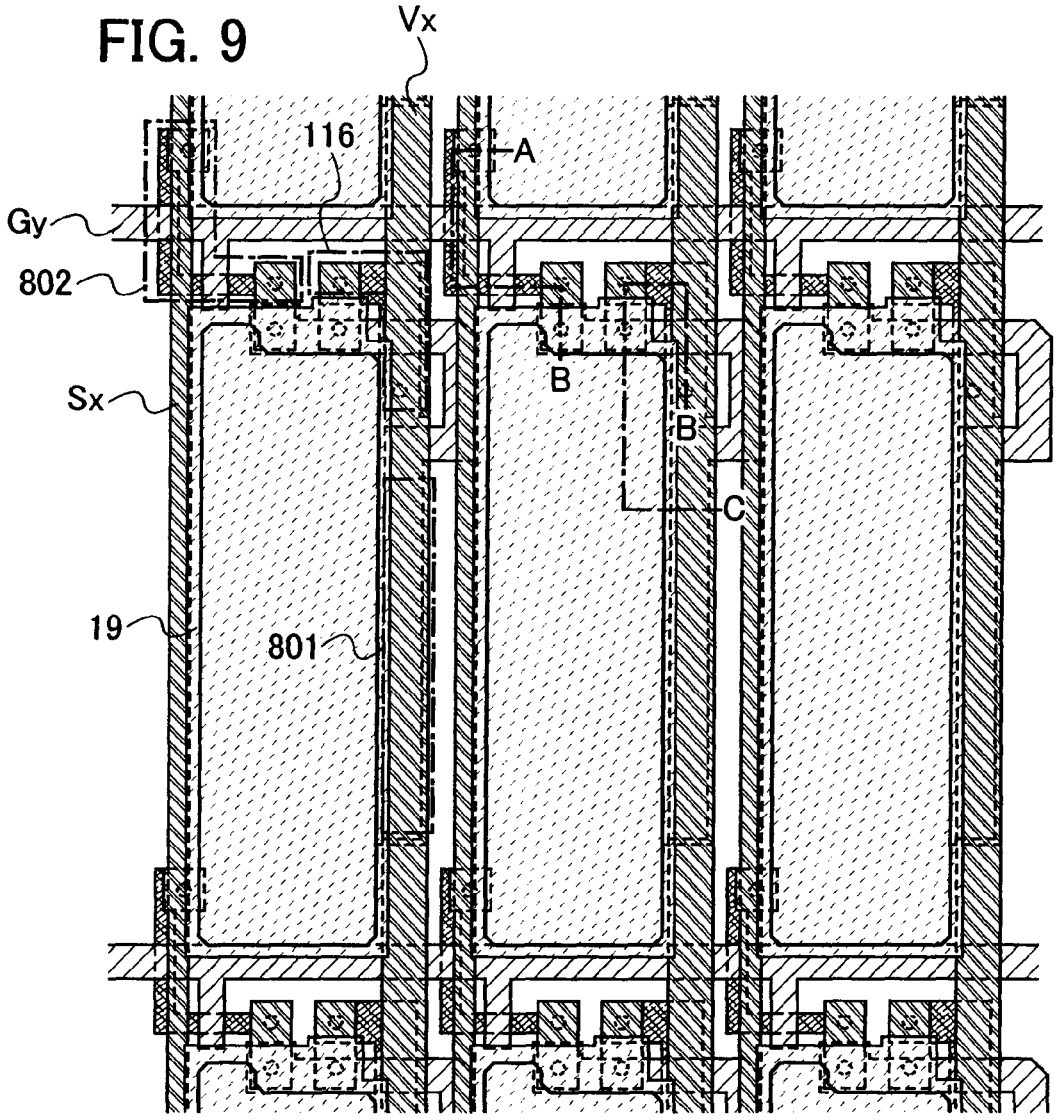
FIG. 9 is a view for showing a layout of a pixel circuit of the present invention.
Figure 15:
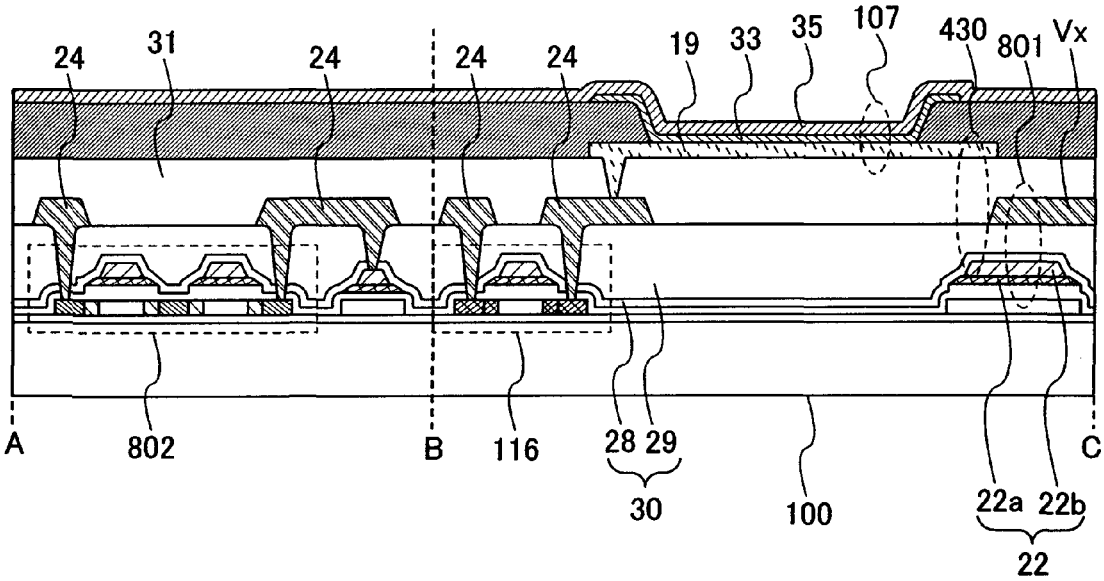
FIG. 15 is a view for showing a cross-sectional view of a pixel circuit of the present invention.

FIG. 9 shows an example of a layout of the pixel circuit shown in FIG. 8A. In addition, FIG. 15 shows an example of a cross-sectional view taken along A-B and B-C shown in FIG. 9. A semiconductor film is formed to constitute the switching transistor 802 and the driving transistor 116. Thereafter, a first conductive film is formed with an insulating film serving as a gate insulating film interposed therebetween. The conductive film is used as gate electrodes of the switching transistor 802 and the driving transistor 116, and can also be used as the scanning line Gy. At this time, the switching transistor 802 preferably has a double gate structure.

Thereafter, a second conductive film is formed with an insulating film serving as an interlayer insulating film interposed between the first and second conductive films. The second conductive film is used as a drain electrode wiring and a source electrode wiring of the switching transistor 802 and the driving transistor 116, and can be used as the signal line Sx and the power supply line Vx. At this time, the capacitor element 801 can be formed to have a stacked-layer structure of the first conductive film, the insulating film serving as an interlayer insulating film, and the second conductive film. The gate electrode of the driving transistor 116 and the other electrode of the switching transistor is connected to each other through a contact hole.

Then, a pixel electrode 19 is formed in an opening provided in the pixel. The pixel electrode is connected to the other electrode of the driving transistor 116. In a case where an insulating film or the like is provided between the second conductive film and the pixel electrode at this time, the pixel electrode is needed to be connected to the other electrode of the driving transistor 116 through the contact hole. In a case where an insulating film or the like is not provided, the pixel electrode can be directly connected to the other electrode of the driving transistor 116.

In the layout as shown in FIG. 9, the first conductive film and the pixel electrode may be overlapped with each other like a region 430 in order to achieve a high aperture ratio. In such a region 430, coupling capacitance may occur. This coupling capacitance is unwanted. Such an unwanted capacitance can be removed by a driving method of the present invention.

Over an insulating substrate 100, a semiconductor film processed into a predetermined shape is provided with a base film interposed therebetween. As for the insulating substrate 100, a glass substrate such as a barium borosilicate glass substrate or an alumino borosilicate glass substrate, a quartz substrate, a stainless steel (SUS) substrate, or the like may be used. Alternatively, a synthetic resin substrate having flexibility such as a plastic substrate typified by PET (polyethylene terephthalate), PEN (polyethylene naphthalate), or PES (polyether sulfone) and an acrylic substrate can be used as long as the substrate can withstand the processing temperatures during the manufacturing process, although the substrate generally has the lower heat resistance temperature as compared with other substrates. As for the base film, an insulating film formed from silicon oxide, silicon nitride, silicon nitride oxide, or the like can be used.

An amorphous semiconductor film is formed over the base film. A thickness of the amorphous semiconductor film is 25 to 100 nm (preferably, 30 to 60 nm). Further, in addition to silicon, silicon germanium can be used for the amorphous semiconductor.

Next, the amorphous semiconductor film is crystallized as needed to form a crystalline semiconductor film. The crystallization can be performed by using a heating furnace, laser irradiation, irradiation of light emitted from a lamp (hereinafter referred to as lamp annealing), or a combination thereof. For example, a crystalline semiconductor film is formed by adding a metal element to an amorphous semiconductor film and applying heat treatment using a heating furnace. As described above, it is preferable because the amorphous semiconductor film can be crystallized at the low temperature by adding the metal element.

The crystalline semiconductor film formed as described above is processed (patterning) into a predetermined shape. The predetermined shape indicates shapes of the switching transistor 802 and the driving transistor 116 as shown in FIG. 15.

Subsequently, an insulating film serving as a gate insulating film is formed. The insulating film is formed with a thickness of 10 to 150 nm, preferably, 20 to 40 nm, so as to cover the semiconductor film. For example, a silicon oxynitride film, a silicon oxide film, or the like can be used, and the insulating film may have a single-layer structure or a stacked-layer structure.

Then, a first conductive film serving as a gate electrode is formed with the gate insulating film interposed between the semiconductor film and the first conductive film. Although the gate electrode may be a single layer or a stacked layer, a stacked-layer structure of conductive films 22*a* and 22*b* is used in this embodiment mode. Each of the conductive films 22*a* and 22*b* may be formed from an element selected from Ta, W, Ti, Mo, Al, and Cu, or an alloy material or a compound material containing the element as its main component. In this embodiment mode, a tantalum nitride film as the conductive film 22*a* with a thickness of 10 to 50 nm, for example, 30 nm, and a tungsten film as the conductive film 22*b* with a thickness of 200 to 400 nm, for example, 370 nm are sequentially formed.

An impurity element is added using the gate electrode as a mask. At this time, a low concentration impurity region may be formed in addition to a high concentration impurity region. The low concentration impurity region is called a LDD (Lightly Doped Drain) structure. In particular, a structure in which the low concentration impurity region is overlapped with the gate electrode is called a GOLD (Gate-drain Overlapped LDD) structure. In particular, an n-channel transistor preferably has a structure having a low concentration impurity region.

Unwanted capacitance may be formed due to this low concentration impurity region. Therefore, in a case of forming a pixel using a TFT having a LDD structure and a GOLD structure, the driving method of the present invention is preferably used.

Thereafter, insulating films 28 and 29 serving as an interlayer insulating film 30 are formed. The insulating film 28 may contain nitrogen, and it is formed using a silicon nitride film with a thickness of 100 nm by a plasma CVD method in this embodiment mode. Further, the insulating film 29 can be formed using an organic material or an inorganic material. As the organic material, polyimide, acrylic, polyamide, polyimide amide, benzocyclobutene, siloxane, and polysilazane can be used. Siloxane has a skeleton structure formed by a bond of silicon (Si) and oxygen (O), in which a polymer material containing at least hydrogen as a substituent or at least one of fluorine, an alkyl group, or aromatic hydrocarbon as the substituent is used as a starting material. Polysilazane is formed of a polymer material having the bond of silicon (Si) and nitrogen (N), that is, a liquid material containing polysilazane, as a starting material. As the inorganic material, an insulating film containing oxygen or nitrogen such as silicon oxide ($SiO_x$), silicon nitride ($SiN_x$), silicon oxynitride ($SiO_xN_y$) (x>y), and silicon nitride oxide ($SiN_xO_y$) (x>y) (x, y=1, 2 . . . ) can be used. Further, the insulating film 29 may have a stacked-layer structure of these insulating films. In particular, when the insulating film 29 is formed by using an organic material, planarity is improved whereas moisture and oxygen are absorbed by the organic material. In order to prevent this, an insulating film containing an inorganic material may be formed over the organic material. When an insulating film containing nitrogen is used as the inorganic material, alkali ions such as Na can be prevented from entering, which is preferable.

A contact hole is formed in the interlayer insulating film 30. Then, a second conductive film is formed, which serves as source electrode wirings and drain electrode wirings 24 of the switching transistor 802 and the driving transistor 116, a signal line Sx, and a power supply line Vx. As for the second conductive film, a film made from an element of aluminum (Al), titanium (Ti), molybdenum (Mo), tungsten (W), and silicon (Si), or an alloy film using these elements can be used. In this embodiment mode, the second conductive film is formed by stacking a titanium film, a titanium nitride film, a titanium-aluminum alloy film, and a titanium film, which respectively have thicknesses of 60 nm, 40 nm, 300 nm, and 100 nm.

Thereafter, an insulating film 31 is formed so as to cover the second insulating film. As for the insulating film 31, the materials of the interlayer insulating film 30 can be used. By providing the insulating film 31 in such a manner, an aperture ratio can be enhanced.

Then, a pixel electrode (also referred to as a first electrode) 19 is formed in an opening in the insulating film 31. In order to enhance step coverage of the pixel electrode in the opening, an end portion of the opening is rounded to have a plurality of curvature radiuses. The pixel electrode 19 may be formed using a material having a light transmitting property such as indium tin oxide (ITO), indium zinc oxide (IZO) obtained by mixing 2 to 20% of zinc oxide (ZnO) into indium oxide, ITO—$SiO_x$ (also referred to as ITSO) obtained by mixing 2 to 20% of silicon oxide ($SiO_2$) into indium oxide, organic indium, and organotin. The pixel electrode 19 may also be formed using a light shielding material such as an element selected from silver (Ag), tantalum, tungsten, titanium, molybdenum, aluminum, and copper, or an alloy material or a compound material containing the element as its main component. When the insulating film 31 is formed using an organic material to improve planarity at this time, the planarity of a surface on which the pixel electrode is formed is improved. Therefore, the constant voltage can be applied, and furthermore, short-circuit can be prevented.

In a region 430 in which the first conductive film and the pixel electrode are overlapped with each other, coupling capacitance may occur. This coupling capacitance is unwanted. Such unwanted capacitance may be removed by the driving method of the present invention.

Thereafter, an electroluminescence layer 33 is formed by an evaporation method or an inkjet method. The electroluminescence layer 33 includes an organic material or an insulating material, and is formed by appropriately combining an electron injecting layer (EIL), an electron transporting layer (ETL), a light emitting layer (EML), a hole transporting layer (HTL), a hole injecting layer (HIL), and the like. It is to be noted that boundaries of each layer are not necessarily. In some cases, materials each of which forms a layer is partially mixed, and interfaces are unclear. The electroluminescence layer is not limited to the above stacked-layer structure.

Then, a second electrode 35 is formed by a sputtering method or an evaporating method. The first electrode (pixel electrode) 19 and the second electrode 35 of the electroluminescence layer (light emitting element) are to be an anode or a cathode depending on a pixel structure.

As for an anode material, a high work function (work function of greater than or equal to 4.0 eV) metal, alloy, or electric conductive compound, a mixture thereof, or the like is preferably used. As a specific example of the anode material, gold (Au), platinum (Pt), nickel (Ni), tungsten (W), chromium (Cr), molybdenum (Mo), iron (Fe), cobalt (Co), copper (Cu), palladium (Pd), nitride of a metal material (TiN), or the like can be used in addition to ITO and IZO obtained by mixing 2 to 20% of zinc oxide (ZnO) into indium oxide.

On the other hand, as a cathode material, a low work function (work function less than or equal to 3.8 eV) metal, alloy, electric conductive compound, a mixture thereof, or the like is preferably used. As a specific example of the cathode material, it is possible to use an element belonging to group 1 or group 2 of the periodic table, namely an alkali metal such as Li and Cs, an alkaline earth metal such as Mg, Ca and Sr, an alloy (Mg:Ag, Al:Li) or a compound (LiF, CsF, $CaF_2$) containing them, and a transition metal including a rare earth metal. It is to be noted that the cathode is needed to have a light transmitting property. Therefore, these metals or alloys containing the metals are formed extremely thin and stacked with a metal (including an alloy) such as ITO.

Thereafter, a protective film covering the second electrode 35 may be formed. As the protective film, a silicon nitride film or a DLC film can be used.

As described above, the pixel of a light emitting device can be formed.

Embodiment Mode 7

In this embodiment mode, a configuration of a whole panel that has the pixel circuit shown in the above embodiment mode will be explained.

Figure 12:
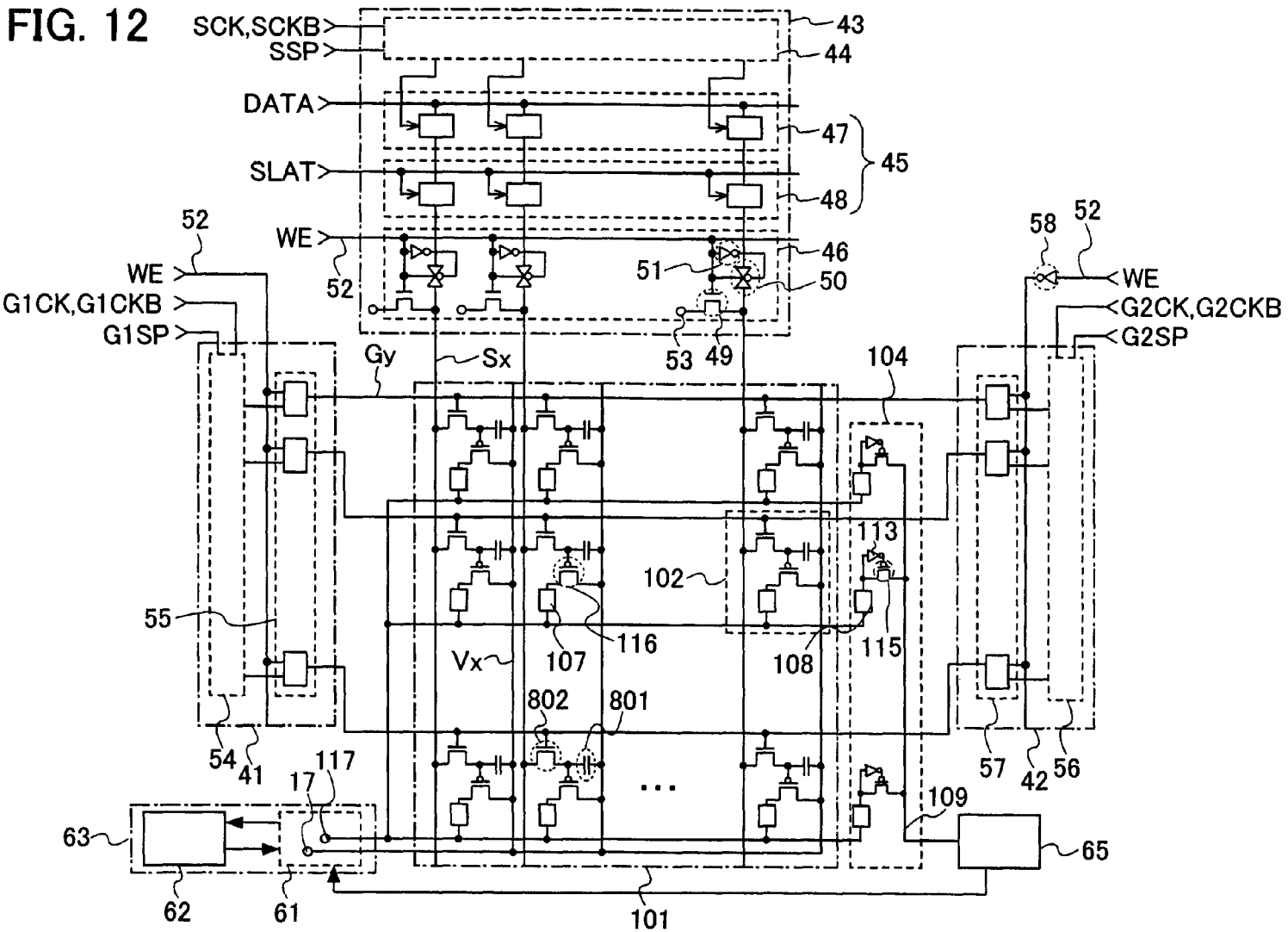
FIG. 12 is a configuration diagram of a light emitting device of the present invention.

As shown in FIG. 12, a light emitting device of the present invention includes a pixel portion 101 in which a plurality of the above pixels 102 is arranged in matrix, a first scanning line driver circuit 41, a second scanning line driver circuit 42, and a signal line driver circuit 43. The first scanning line driver circuit 41 and the second scanning line driver circuit 42 may be arranged to face each other with the pixel portion 101 interposed therebetween, or arranged on any one of the four sides: left, right, top, and bottom of the pixel portion 101.

The signal line driver circuit 43 includes a pulse output circuit 44, a latch 45, and a selection circuit 46. The latch 45 has a first latch 47 and a second latch 48. The selection circuit 46 has a transistor 49 (hereinafter, described as a TFT 49) and an analog switch 50 as switching units. The TFT 49 and the analog switch 50 are provided in each column corresponding to a signal line. In addition, in this embodiment mode, a switching circuit 51 is provided in each column to generate an inverted signal of a WE signal. It is to be noted that the switching circuit 51 is not necessary to be provided in a case where the inverted signal of the WE signal is supplied externally.

A gate electrode of the TFT 49 is connected to a selection signal line 52. One of the electrodes thereof is connected to a signal line Sx, and the other electrode is connected to a power supply 53. The analog switch 50 is provided between the second latch 48 and each signal line. In other words, an input terminal of the analog switch 50 is connected to the second latch 48, and an output terminal is connected to the signal line. The analog switch 50 has two control terminals, one of which is connected to the selection signal line 52, and the other of which is connected to the selection signal line 52 through the switching circuit 51. The power supply 53 has potential that turns off the driving transistor 116 in each pixel, and the potential of the power supply 53 is at an L level in a case where the driving transistor 116 has n-channel polarity, while the potential of the power supply 53 is at an H level in a case where the driving transistor 116 has p-channel polarity.

The first scanning line driver circuit 41 has a pulse output circuit 54 and a selection circuit 55. The second scanning line driver circuit 42 has a pulse output circuit 56 and a selection circuit 57. Start pulses (G1SP and G2SP) are respectively inputted to the pulse output circuits 54 and 56. Further, clock pulses (G1CK and G2CK) and inverted clock pulses (G1CKB and G2CKB) thereof are respectively inputted to the pulse output circuits 54 and 56.

The selection circuits 55 and 57 are connected to the selection signal line 52. It is to be noted that the selection circuit 57 included in the second scanning line driver circuit 42 is connected to the selection signal line 52 through a switching circuit 58. That is to say, WE signals that are inputted to the selection circuits 55 and 57 through the selection signal line 52 are inverted from each other.

Each of the selection circuits 55 and 57 has a tri-state buffer. The tri-state buffer becomes an operation state in a case where a signal inputted from the selection signal line 52 is at an H level, while the tri-state buffer becomes a high impedance state in a case where the signal is at an L level.

Each of the pulse output circuit 44 included in the signal line driver circuit 43, the pulse output circuit 54 included in the first scanning line driver circuit 41, and the pulse output circuit 56 included in the second scanning line driver circuit 42 has a shift register including a plurality of flip-flop circuits or a decoder circuit. When a decoder circuit is used as the pulse output circuits 44, 54, and 56, a signal line or a scanning line can be selected at random. When the signal line or the scanning line can be selected at random, pseudo-contour can be prevented from occurring in a case where a time grayscale method is adopted.

It is to be noted that the configuration of the signal line driver circuit 43 is not limited to the above one, and a level shifter or a buffer may be provided additionally. The configurations of the first scanning line driver circuit 41 and the second scanning line driver circuit 42 are not also limited to the above one, and a level shifter or a buffer may be provided additionally. Further, each of the signal line driver circuit 43, the first scanning line driver circuit 41, and the second scanning line driver circuit 42 may have a protection circuit.

In the present invention, a protection circuit may be provided. The protection circuit can include a plurality of resistance elements. For example, p-channel transistors can be used as the plurality of resistance elements. The protection circuit can be provided in each of the signal line driver circuit 43, the first scanning line driver circuit 41, and the second scanning line driver circuit 42. The protection circuit is preferably provided between the pixel portion 101 and the signal line driver circuit 43, the first scanning line driver circuit 41, or the second scanning line driver circuit 42. Such a protection circuit can suppress time degradation or destruction of elements due to static electricity.

In this embodiment mode, the light emitting device includes a power supply control circuit 63. The power supply control circuit 63 has a controller 62 and a power supply circuit 61 that supplies power to a light emitting element 107. The power supply circuit 61 has a first power supply 17 that is connected to a pixel electrode of the light emitting element 107 through the driving transistor 116 and the power supply line Vx. The power supply circuit 61 also has a second power supply 117 that is connected to the light emitting element 107 through the power supply line connected to an opposite electrode.

In such a power supply circuit 61, when the forward bias voltage is applied to the light emitting element 107 so that the light emitting element 107 is supplied with the current and emits light, potential of the first power supply 17 is set to be higher than that of the second power supply 117. On the other hand, when the reverse bias voltage is applied to the light emitting element 107, the potential of the first power supply 17 is set to be lower than that of the second power supply 117. Such a setting of the power supply can be performed by supplying a predetermined signal from the controller 62 to the power supply circuit 61.

In this embodiment mode, the light emitting device includes a monitor circuit 104 and a control circuit 65. The control circuit 65 has a constant current source 111 and a buffer amplifier circuit 112. The monitor circuit 104 has a monitor element 108, a control transistor 115, and a switching circuit 113.

The control circuit 65 supplies a signal that corrects power supply potential to the power supply control circuit 63 based on output of the monitor circuit 104. The power supply control circuit 63 corrects power supply potential that is supplied to the pixel portion 101 based on a signal that is supplied from the control circuit 65.

In the light emitting device of the present invention that has the above configuration, variations in a current value due to temperature change and time degradation change can be suppressed, and reliability can be improved. Further, the control transistor 115 and the switching circuit 113 can prevent supply of the current from the constant current source 111 to the monitor element 108 that is shorted, so that variations in a current value can be accurately supplied to the light emitting element 107.

Embodiment Mode 8

In this embodiment mode, operation of a light emitting device of the present invention, which has the above configuration, will be explained with reference to drawings.

Figure 13A:
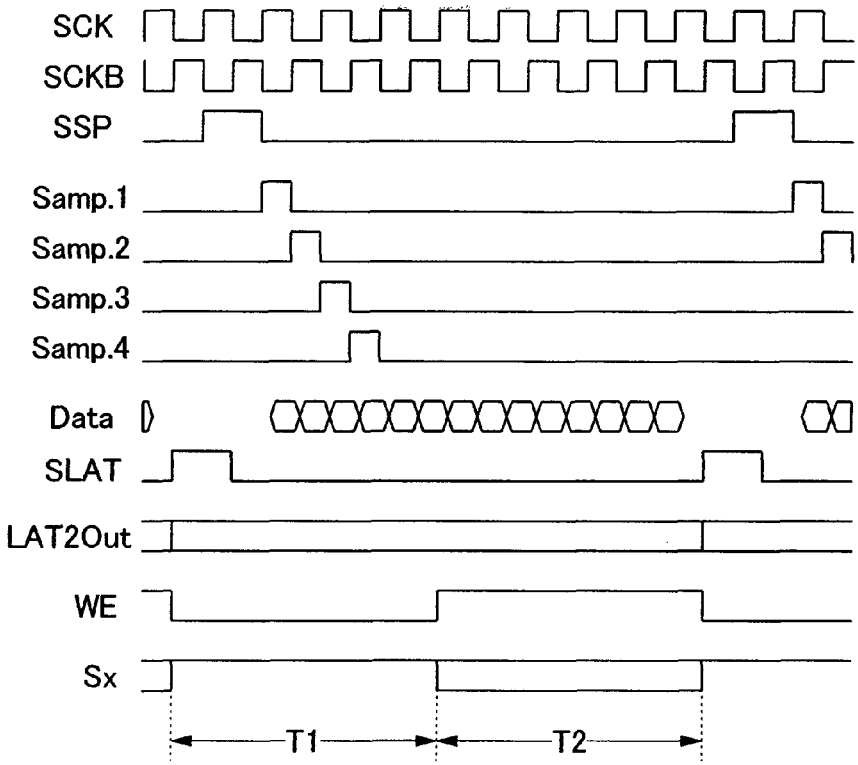
FIGS. 13A and 13B are views for each showing a timing chart of a light emitting device of the present invention.

First, operation of the signal line driver circuit 43 is explained with the use of FIG. 13A. A clock signal (hereinafter, refereed to as SCK), a clock inverter signal (hereinafter, referred to as SCKB), and a start pulse (hereinafter, referred to as SSP) are inputted to the pulse output circuit 44. In according with timing of these signals, a sampling pulse is outputted from the pulse output circuit 44 into the first latch 47. The first latch 47 to which data is inputted holds video signals from the first column to the last column in accordance with the timing of the sampling pulse that is inputted. When a latch pulse is inputted, the video signals held in the first latch 47 are transferred to the second latch 48 all at once.

Here, operation of the selection circuit 46 during each period is explained, on the assumption that a WE signal transmitted from the selection signal line 52 is at an L level during a period T1 while at an H level during a period T2. Each of the periods T1 and T2 corresponds to half of a horizontal scanning period, and the period T1 is referred to as a first subgate selection period while the period T2 is referred to as a second subgate selection period.

During the period T1 (the first subgate selection period), the WE signal transmitted from the selection signal line 52 is at an L level, the transistor 49 is in an on-state, and the analog switch 50 is in a non-conductive state. Then, a plurality of signal lines S1 to Sn is electrically connected to the power supply 53 through the transistors 49 that is arranged in each column. In other words, a plurality of signal lines Sx has the same potential as that of the power supply 53. At this time, the switching transistor 802 in the selected pixel 102 is turned on so that the potential of the power supply 53 is transmitted to the gate electrode of the driving transistor 116 through the switching transistor 802. Then, the driving transistor 116 is turned off so that no current flows between both electrodes of the light emitting element 107 and no light is emitted. Thus, independently of a state of a video signal that is inputted to the signal line Sx, the potential of the power supply 53 is transmitted to the gate electrode of the driving transistor 116 so that the switching transistor 802 is in an off-state, and light emission of the light emitting element 107 is forcibly stopped, which is erasing operation.

During the period T2 (the second subgate selection period), the WE signal transmitted from the selection signal line 52 is at an H level, the transistor 49 is in an off-state, and the analog switch 50 is in a conductive state. Then, video signals of one row, which are held in the second latch 48, are transmitted to each signal line Sx at the same time. At this time, the switching transistor 802 in the pixel 102 is turned on, and a video signal is transmitted to the gate electrode of the driving transistor 116 through the switching transistor 802. In accordance with the inputted video signal, the driving transistor 116 is turned on or off, and the first electrode and the second electrode of the light emitting element 107 have different potentials or the same potential. More specifically, when the driving transistor 116 is turned on, the first electrode and the second electrode of the light emitting element 107 have different potentials so that the current flows in the light emitting element 107, and light is emitted. It is to be noted that the current flowing in the light emitting element 107 is the same as the current flowing between the source electrodes and drain of the driving transistor 116.

On the other hand, when the driving transistor 116 is turned off, the first electrode and the second electrode of the light emitting element 107 have the same potential, and no current flows in the light emitting element 107. That is to say, the light emitting element 107 emits no light. In this manner, in accordance with a video signal, the driving transistor 116 is turned on or off, and the first electrode and the second electrode of the light emitting element 107 have different potentials or the same potential, which is writing operation.

Figure 13B:
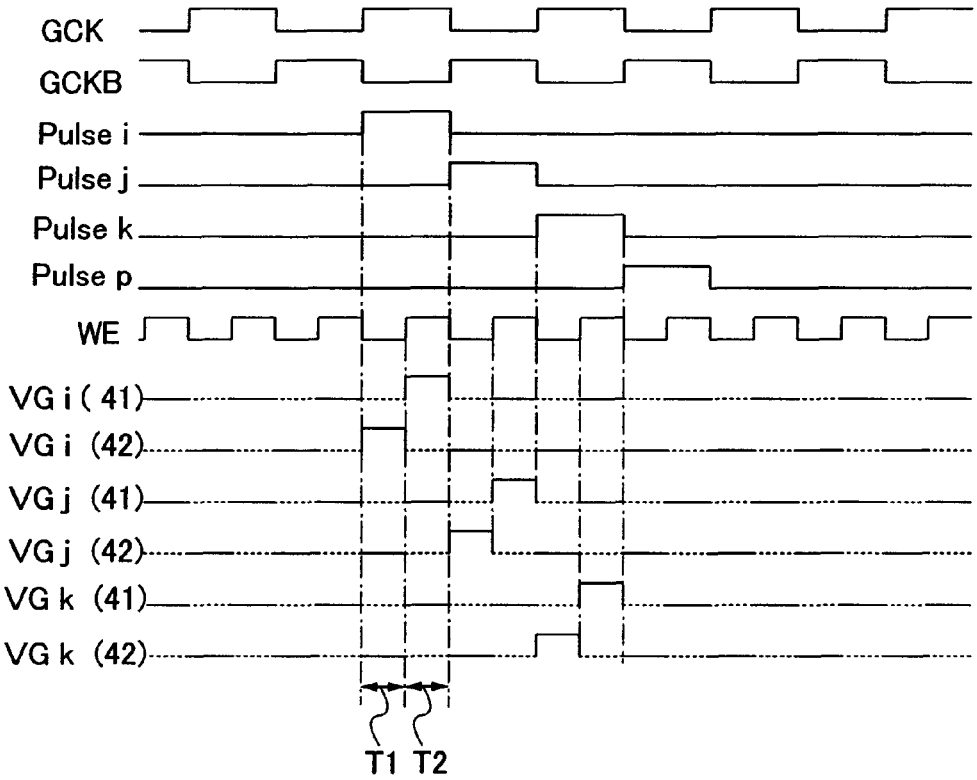

Next, operation of the first scanning line driver circuit 41 and the second scanning line driver circuit 42 is explained. G1CK, G1CKB, and G1SP are inputted into the pulse output circuit 54. In accordance with the timing of these signals, pulses are sequentially outputted to the selection circuit 55. Meanwhile, G2CK, G2CKB, and G2SP are inputted to the pulse output circuit 56. In accordance with the timing of these signals, pulses are sequentially outputted to the selection circuit 57. Potential of the pulses that are supplied to the selection circuits 55 and 57 of each column in the i-th row, the j-th row, the k-th row, and the p-th row (i, j, k, and p are natural numbers, $1 \leqq i, j, k$, and $p \leqq n$) are shown in FIG. 13B.

Here, operation of the selection circuit 55 included in the first scanning line driver circuit 41 and the selection circuit 57 included in the second scanning line driver circuit 42 during each period is explained, on the assumption that a WE signal transmitted from the selection signal line 52 is at an L level during a period T1, while at an H level during a period T2, similarly to the explanation of the operation of the signal line driving circuit 43. It is to be note that, in a timing chart of FIG. 13B, potential of the gate line Gy (y is a natural number, $1 \leqq y \leqq n$) to which a signal is transmitted from the first scanning line driver circuit 41 is described as VGy (41), while potential of the gate line to which a signal is transmitted from the second scanning line driver circuit 42 is described as VGy (42). VGy (41) and VGy (42) can be supplied by the same gate line Gy.

During the period T1 (the first subgate selection period), the WE signal transmitted from the selection signal line 52 is at an L level. Then, an L level WE signal is inputted to the selection circuit 55 included in the first scanning line driver circuit 41, and the selection circuit 55 is in a floating state. On the other hand, an inverted WE signal, namely an H level signal is inputted to the selection circuit 57 included in the second scanning line driver circuit 42 so that the selection circuit 57 is in an operation state. That is to say, the selection circuit 57 transmits an H level signal (row selection signal) to a gate line Gi of the i-th row so that the gate line Gi has the same potential as that of the H level signal. In other words, the gate line Gi of the i-th row is selected by the second scanning line driver circuit 42. As a result, the switching transistor 802 in the pixel 102 is turned on. Potential of the power supply 53 included in the signal line driver circuit 43 is transmitted to the gate electrode of the driving transistor 116 so that the driving transistor 116 is turned off and the potentials of both electrodes of the light emitting element 107 become equal to each other. That is to say, during the period T1, the erasing operation in which the light emitting element 107 emits no light is performed.

During the period T2 (the second subgate selection period), the WE signal transmitted from the selection signal line 52 is at an H level. Then, an H level WE signal is inputted to the selection circuit 55 included in the first scanning line driver circuit 41 so that the selection circuit 55 is in an operation state. In other words, the selection circuit 55 transmits an H level signal to the gate line Gi of the i-th row so that the gate line Gi has the same potential as that of the H level signal. That is to say, the gate line Gi of the i-th row is selected by the first scanning line driver circuit 41. As a result, the switching transistor 802 in the pixel 102 is in an on-state. A video signal is transmitted from the second latch 48 included in the signal line driver circuit 43 to the gate electrode of the driving transistor 116 so that the driving transistor 116 is turned on or off, and the two electrodes of the light emitting element 107 have different potentials or the same potential. In other words, during the period T2, the writing operation in which the light emitting element 107 emits light or no light is performed. On the other hand, an L level signal is inputted to the selection circuit 57 included in the second scanning line driver circuit 42, and the selection circuit 57 is in a floating state.

Thus, the gate line Gy is selected by the second scanning line driver circuit 42 during the period T1 (the first subgate selection period), while selected by the second scanning line driver circuit 42 during the period T2 (the second subgate selection period). That is to say, the gate line is controlled by the first scanning line driver circuit 41 and the second scanning line driver circuit 42 in a complementary manner. During one of the first subgate selection period and the second subgate selection period, the erasing operation is performed, and the writing operation is performed during the other period.

During the period in which the first scanning line driver circuit 41 selects the gate line Gi of the i-th row, the second scanning line driver circuit 42 does not operate (the selection circuit 57 is in a floating state), or transmits a row selection signal to gate lines of rows other than the i-th row. Similarly, during the period in which the second scanning driver line circuit 42 transmits the row selection signal to the gate line Gi of the i-th row, the first scanning line driver circuit 41 is in a floating state, or transmits the row selection signal to gate lines of rows other than the i-th row.

According to the present invention performing the above operation, the light emitting element 107 can be forcibly turned off, which improves the duty ratio. Further, although the light emitting element 107 can be turned off forcibly, a TFT for discharging the charge of the capacitor element 801 is not necessary to be provided, whereby a high aperture ratio is achieved. With the high aperture ratio, the luminance of the light emitting element can be lowered with an increase in a light emitting area. That is to say, the driving voltage can be reduced, thereby reducing power consumption.

It is to be noted that the present invention is not limited to the above mode in which a gate selection period is divided into two. A gate selection period may be divided into three or more.

Embodiment Mode 9

In this embodiment mode, a pixel configuration to which a driving method of the present invention can be applied will be explained as an example. It is to be noted that explanation of which a configuration is the same as that shown in FIG. 8A is omitted.

Figure 10A:
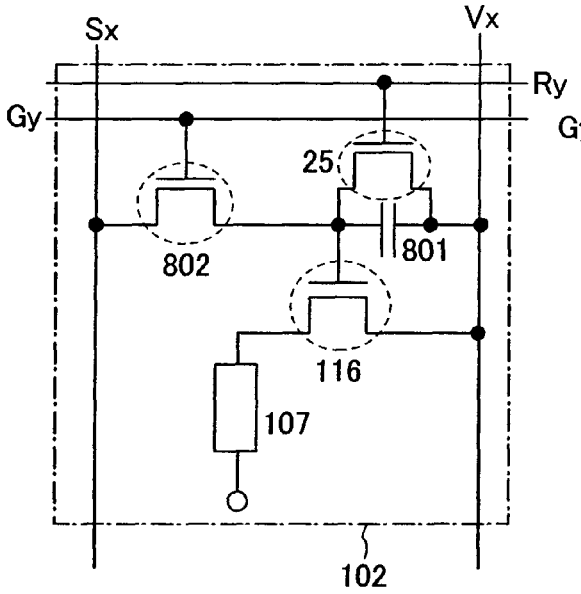
FIGS. 10A to 10D are diagrams for each showing a pixel circuit of the present invention.

FIG. 10A shows a pixel configuration where a third transistor 25 is provided on both ends of the capacitor element 801 in the pixel configuration shown in FIG. 8A. The third transistor 25 has a function for discharging charges accumulated in the capacitor element 801 for a predetermined period. This third transistor 25 is also referred to as an erasing transistor. The predetermined period is controlled by an erasing scanning line Ry connected to a gate electrode of the third transistor 25.

For example, in a case of providing a plurality of subframe periods, the charges in the capacitor element 801 is discharged by the third transistor 25 in a short subframe period. As a result, a duty ratio can be improved.

Figure 10B:
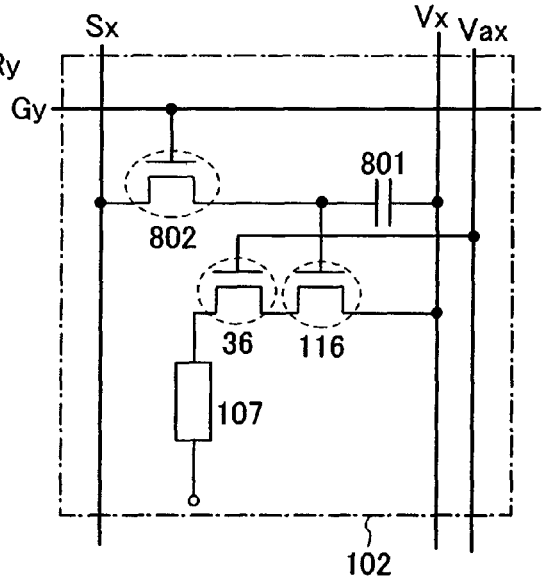

FIG. 10B shows a pixel configuration where a fourth transistor 36 is provided between the driving transistor 116 and the light emitting element 107 in the pixel configuration shown in FIG. 8A. A second power supply line Vax at constant potential is connected to a gate electrode of the fourth transistor 36. Therefore, the current supplied to the light emitting element 107 can be constant, regardless of the gate-source electrode voltage of the driving transistor 116 or the fourth transistor 36. The fourth transistor 36 is also referred to as a current control transistor.

Figure 10C:
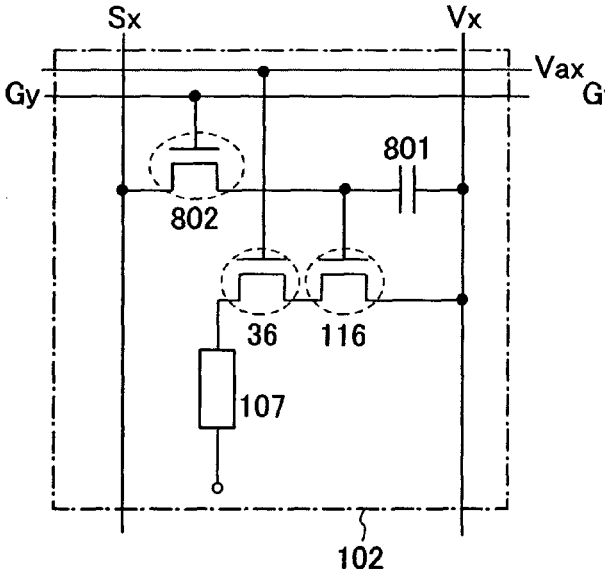

FIG. 10C shows a pixel configuration where the second power supply line Vax at constant potential is provided in parallel to the scanning line Gy, which is different from FIG. 10B.

Figure 10D:
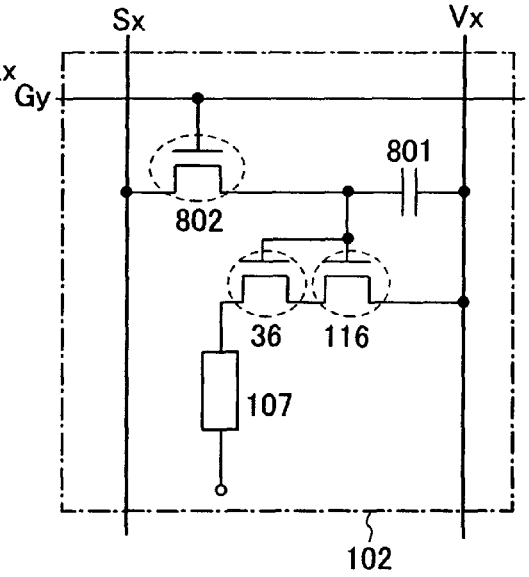

FIG. 10D shows a pixel configuration where the gate electrode of the fourth transistor 36 at constant potential is connected to the gate electrode of the driving transistor 116, which is different from FIGS. 10B and 10C. An aperture ratio can be maintained in the pixel configuration where a power supply line is not additionally provided as shown in FIG. 10D.

Figure 11:
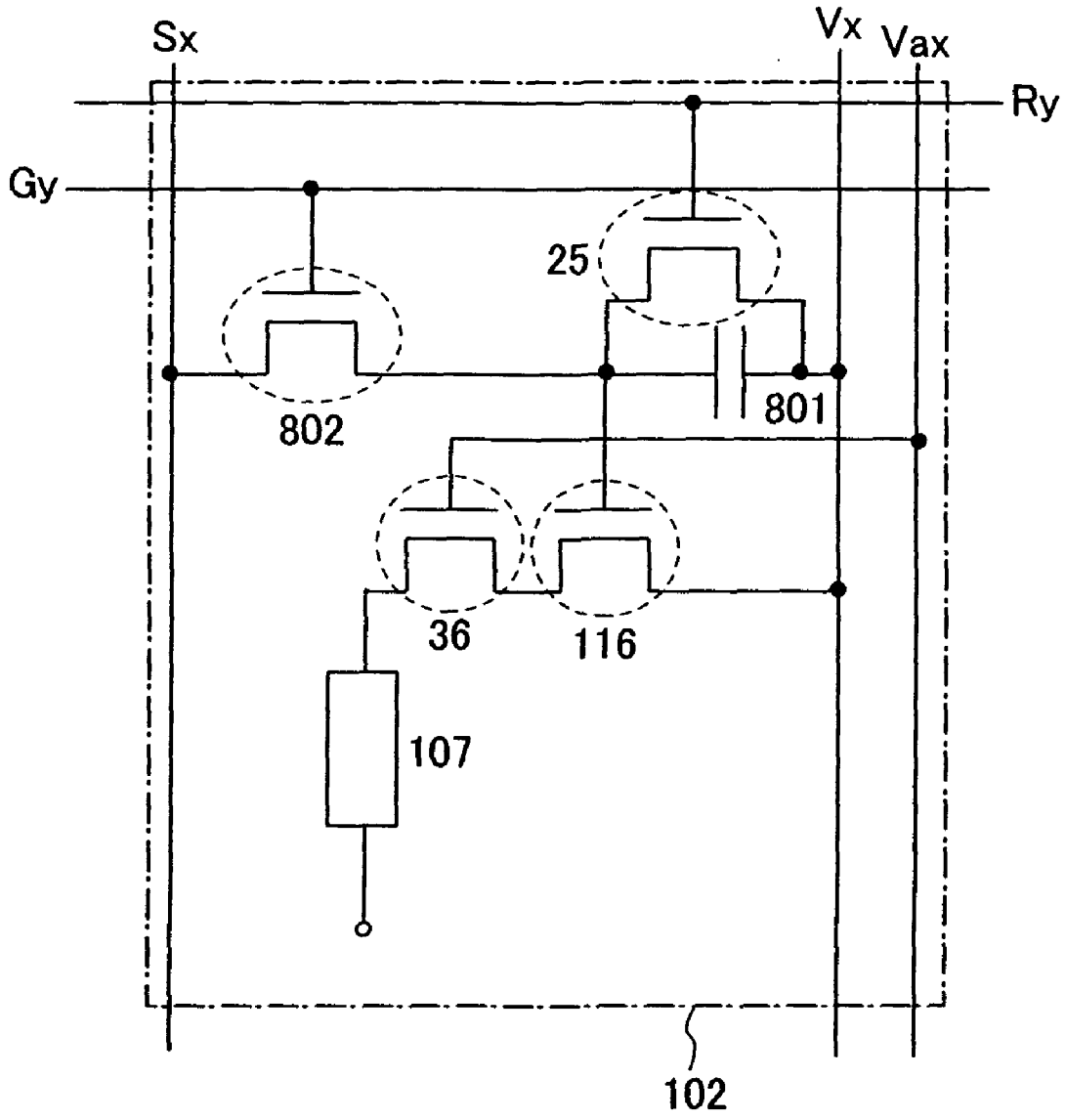
FIG. 11 is a diagram for showing a pixel circuit of the present invention.

FIG. 11 shows a pixel configuration where the erasing transistor 25 is provided in the pixel configuration shown in FIG. 10B. By the erasing transistor 25, the charges in the capacitor element 801 can be discharged. As a matter of course, an erasing transistor can be provided in the pixel configuration shown in FIG. 10C or 10D.

That is, the present invention can be implemented without being limited to the pixel configuration.

Embodiment Mode 10

The present invention can be applied to a light emitting device driven with the constant current. In this embodiment mode, the degree of changes with time is detected by using the monitor element 108, and a case in which the change with time of the light emitting element is compensated by correcting a video signal or power supply potential based on the detected result will be explained.

In this embodiment mode, a first monitor element and a second monitor element are provided. The constant current is supplied from a first constant current source to the first monitor element. The constant current is supplied from a second constant current source to the second monitor element. By supplying different current values between the first constant current source and the second constant current source, the total amount of current flowing to the first and second monitor elements can be made different. As a result, the first monitor element and the second monitor element change differently with time.

The first and second monitor elements are connected to an arithmetic circuit. The arithmetic circuit calculates a potential difference between the first monitor element and the second monitor element. The voltage value calculated by the arithmetic circuit is supplied to a video signal generating circuit. The video signal generating circuit corrects a video signal supplied to each pixel based on the voltage value supplied from the arithmetic circuit. With such a configuration, changes with time of the light emitting element can be compensated.

A circuit such as a buffer amplifier circuit for preventing variations in potential is preferably provided between each monitor element and the light emitting element.

In this embodiment mode, for example, a pixel using a current mirror circuit or the like can be used as a pixel driven with the constant current.

Embodiment Mode 11

The present invention can be applied to a passive matrix light emitting device. A passive matrix light emitting device includes a pixel portion formed over a substrate, a column signal line driver circuit provided in the periphery of the pixel portion, a row signal line driver circuit, and a controller for controlling the above driver circuits. The pixel portion has column signal lines arranged in the column direction, row signal lines arranged in the row direction, and a plurality of light emitting elements arranged in matrix. The monitor circuit 104 can be provided over which the substrate the pixel portion is formed.

In the light emitting device of this embodiment mode, image data inputted to the column signal line driver circuit and the voltage generated from a constant voltage source can be corrected in accordance with temperature change and change with time by using the monitor circuit 104. Accordingly, a light emitting device can be provided with reduced effect due to the temperature change and the change with time.

Embodiment Mode 12

An electronic device provided with a pixel portion including a light emitting element includes: a television set (simply referred to as a TV or a television receiver), a camera such as a digital camera and a digital video camera, a mobile phone set (simply referred to as a cellular phone set or a cellular phone), a portable information terminal such as a PDA, a portable game machine, a monitor for a computer, a computer, an audio reproducing device such as a car audio set, an image reproducing device provided with a recording medium such as a home game machine, and the like. Specific examples thereof are explained with reference to FIGS. 14A to 14F.

Figure 14A:
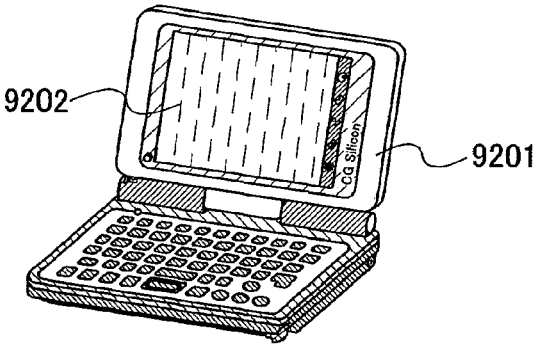
FIGS. 14A to 14F are views for each showing an electronic device on which the present invention is mounted.

A portable information terminal device shown in FIG. 14A includes a main body 9201, a display portion 9202, and the like. The light emitting device of the present invention can be applied to the display portion 9202. That is to say, according to the present invention in which the power supply potential applied to the light emitting element is corrected by using the monitor element, it is possible to provide a portable information terminal device in which the effect of variations in the current value of the light emitting element due to temperature change of and change with time is suppressed.

Figure 14B:
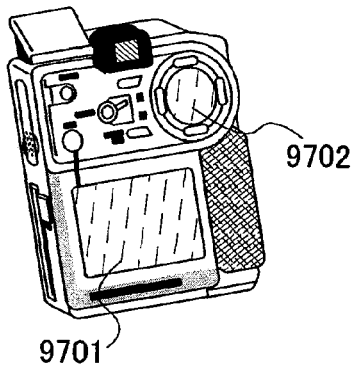

A digital video camera shown in FIG. 14B includes a display portion 9701, a display portion 9702, and the like. The light emitting device of the present invention can be applied to the display portion 9701. According to the present invention in which the power supply potential applied to the light emitting element is corrected by using the monitor element, it is possible to provide a digital video camera in which the effect of variations in the current value of the light emitting element due to temperature change and change with time is suppressed.

Figure 14C:
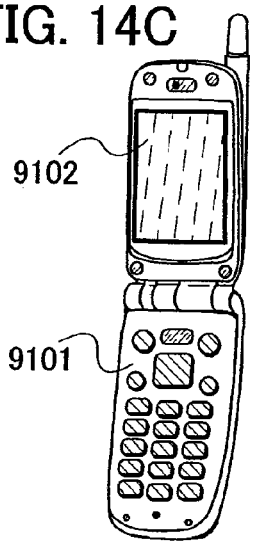

A cellular phone set shown in FIG. 14C includes a main body 9101, a display portion 9102, and the like. The light emitting device of the present invention can be applied to the display portion 9102. According to the present invention in which the power supply potential applied to the light emitting element is corrected by using the monitor element, it is possible to provide a cellular phone set in which the effect of variations in the current value of the light emitting element due to temperature change and change with time is suppressed.

Figure 14D:
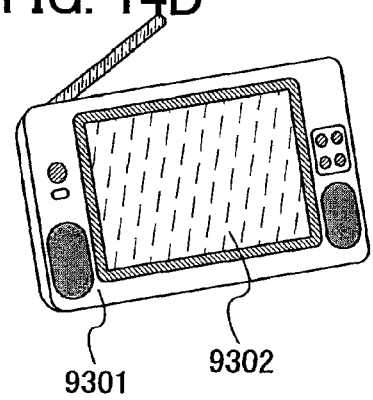

A portable television set shown in FIG. 14D includes a main body 9301, a display portion 9302, and the like. The light emitting device of the present invention can be applied to the display portion 9302. According to the present invention in which the power supply potential applied to the light emitting element is corrected by using the monitor element, it is possible to provide a portable television set in which the effect of variations in the current value of the light emitting element due to temperature change and change with time is suppressed. The light emitting device of the present invention can be applied to various types of television sets such as a small-sized television incorporated in a portable terminal such as a cellular phone set, a medium-sized television that is portable, and a large-sized television (for example, greater than or equal to 40 inches in size).

Figure 14E:
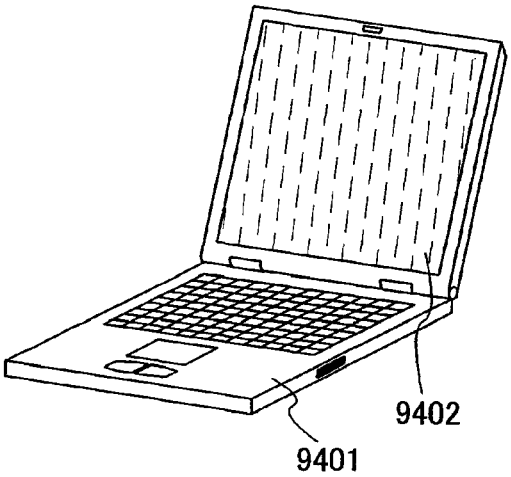

A portable computer shown in FIG. 14E includes a main body 9401, a display portion 9402 and the like. The light emitting device of the present invention can be applied to the display portion 9402. According to the present invention in which the power supply potential applied to the light emitting element is corrected by using the monitor element, it is possible to provide a portable computer in which the effect of variations in the current value of the light emitting element due to temperature change and change with time is suppressed.

Figure 14F:
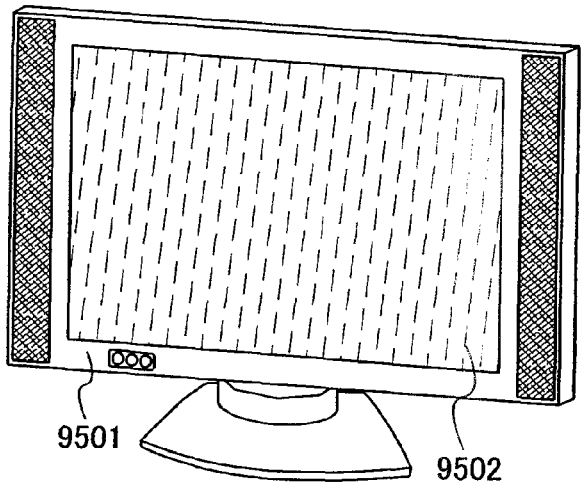

A television set shown in FIG. 14F includes a main body 9501, a display portion 9502, and the like. The light emitting device of the present invention can be applied to the display portion 9502. According to the present invention in which the power supply potential applied to the light emitting element is corrected by using the monitor element, it is possible to provide a television set in which the effect of variations in the current value of the light emitting element due to temperature change and change with time is suppressed.

This application is based on Japanese Patent Application serial no. 2005-375405 filed in Japan Patent Office on Dec. 27, 2005, the entire contents of which are hereby incorporated by reference.

What is claimed is:

1. A light emitting device comprising:

a first monitor element;

a second monitor element;

a monitor line electrically connected to the first monitor element and the second monitor element;

a first circuit for electrically interrupting a current supplied to the first monitor element depending on data received by the first circuit from the first monitor element in a case where anode potential of the first monitor element is lowered;

a second circuit electrically connected to the second monitor element;

a first inverter provided in the first circuit and having an input terminal connected to an anode electrode of the first monitor element; and a second inverter provided in the second circuit and having an input terminal connected to an anode electrode of the second monitor element, wherein the first circuit is electrically connected to the second circuit, and wherein a negative power supply of the second inverter is connected to the input terminal of the first inverter.

2. A light emitting device comprising:

a first monitor element;

a second monitor element;

a monitor line electrically connected to the first monitor element and the second monitor element;

a first control transistor for controlling supply of a current from the monitor line to the first monitor element;

a second control transistor for controlling supply of a current from the monitor line to the second monitor element;

a first circuit for turning off the first control transistor depending on data received by the first circuit from the first monitor element in a case where anode potential of the first monitor element is lowered;

a second circuit for turning on the second control transistor in a case where anode potential of the first monitor element is lowered;

a first inverter provided in the first circuit and having an input terminal connected to an anode electrode of the first monitor element; and a second inverter provided in the second circuit and having an input terminal connected to an anode electrode of the second monitor element, wherein a negative power supply of the second inverter is connected to the input terminal of the first inverter.

3. A light emitting device comprising:

a first monitor element;

a second monitor element;

a monitor line electrically connected to the first monitor element and the second monitor element;

a unit for supplying a constant current to the monitor line;

a first control transistor for controlling supply of a current from the monitor line to the first monitor element;

a second control transistor for controlling supply of a current from the monitor line to the second monitor element;

a first circuit for turning off the first control transistor depending on data received by the first circuit from the first monitor element in a case where anode potential of the first monitor element is lowered;

a second circuit for turning on the second control transistor in a case where anode potential of the first monitor element is lowered;

a first inverter provided in the first circuit and having an input terminal connected to an anode electrode of the first monitor element; and a second inverter provided in the second circuit and having an input terminal connected to an anode electrode of the second monitor element, wherein a negative power supply of the second inverter is connected to the input terminal of the first inverter.

4. A light emitting device comprising:

a first monitor element;

a second monitor element that is paired with the first monitor element;

a monitor line electrically connected to the first monitor element and the second monitor element;

a unit for supplying a constant current to the monitor line;

a first control transistor for controlling supply of the current from the monitor line to the first monitor element;

a second control transistor for controlling supply of the current from the monitor line to the second monitor element;

a first circuit for turning off the first control transistor depending on data received by the first circuit from the first monitor element in a case where anode potential of the first monitor element is lowered;

a second circuit to which potential of one of electrodes of the second monitor element and one of electrodes of the second control transistor is inputted and for outputting a potential to a gate electrode of the second control transistor;

a first inverter provided in the first circuit and having an input terminal connected to an anode electrode of the first monitor element; and a second inverter provided in the second circuit and having an input terminal connected to an anode electrode of the second monitor element, wherein the second circuit has a function for turning on the second monitor element in a case where the anode potential of the first monitor element is lowered, and wherein a negative power supply of the second inverter is connected to the input terminal of the first inverter.

5. A light emitting device according to claim 1, further comprising a buffer amplifier circuit that includes an input connected to the monitor line and an output connected to one of electrodes of a driving transistor included in a pixel portion, wherein a voltage applied to a light emitting element included in the pixel portion is changed in accordance with a change of the anode potential of the first monitor element or in accordance with a change of an anode potential of the second monitor element.

6. A light emitting device according to claim 2, further comprising a buffer amplifier circuit that includes an input connected to the monitor line and an output connected to one of electrodes of a driving transistor included in a pixel portion, wherein a voltage applied to a light emitting element included in the pixel portion is changed in accordance with a change of the anode potential of the first monitor element or in accordance with a change of an anode potential of the second monitor element.

7. A light emitting device according to claim 3, further comprising a buffer amplifier circuit that includes an input connected to the monitor line and an output connected to one of electrodes of a driving transistor included in a pixel portion, wherein a voltage applied to a light emitting element included in the pixel portion is changed in accordance with a change of the anode potential of the first monitor element or in accordance with a change of an anode potential of the second monitor element.

8. A light emitting device according to claim 4, further comprising a buffer amplifier circuit that includes an input connected to the monitor line and an output connected to one of electrodes of a driving transistor included in a pixel portion, wherein a voltage applied to a light emitting element included in the pixel portion is changed in accordance with a change of the anode potential of the first monitor element or in accordance with a change of an anode potential of the second monitor element.

* * * * *